US012584667B2

(12) United States Patent
Inoue

(10) Patent No.: US 12,584,667 B2
(45) Date of Patent: Mar. 24, 2026

(54) REFRIGERATION SYSTEM

(71) Applicant: DAIKIN INDUSTRIES, LTD., Osaka (JP)

(72) Inventor: Makoto Inoue, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 244 days.

(21) Appl. No.: 18/236,987

(22) Filed: Aug. 23, 2023

(65) Prior Publication Data

US 2023/0392844 A1 Dec. 7, 2023

Related U.S. Application Data

(63) Continuation of application No. PCT/JP2022/006648, filed on Feb. 18, 2022.

(30) Foreign Application Priority Data

Mar. 10, 2021 (JP) ..... 2021-038438

(51) Int. Cl.
*F25B 49/02* (2006.01)
*F24F 11/36* (2018.01)

(52) U.S. Cl.
CPC ..... *F25B 49/02* (2013.01); *F24F 11/36* (2018.01); *F25B 2500/222* (2013.01)

(58) Field of Classification Search
CPC ..... F24F 11/36; F25B 49/02; F25B 2500/222
See application file for complete search history.

(56) References Cited

U.S. PATENT DOCUMENTS

| | | | | |
|---|---|---|---|---|
| 11,125,457 | B1 * | 9/2021 | Alfano | F24F 11/36 |
| 2019/0032941 | A1 | 1/2019 | Kawai et al. | |
| 2020/0200419 | A1 * | 6/2020 | Ohnishi | F24F 11/88 |
| 2020/0318840 | A1 * | 10/2020 | Wada | F24F 11/84 |

FOREIGN PATENT DOCUMENTS

WO WO 2017/175300 A1 10/2017

OTHER PUBLICATIONS

International Preliminary Report on Patentability and English translation of the Written Opinion of the International Searching Authority for International Application No. PCT/JP2022/006648, dated Sep. 12, 2023.
European Search Report for European Application No. 22766783.9, dated Aug. 8, 2024.
International Search Report for PCT/JP2022/006648 (PCT/ISA/210) mailed on Apr. 26, 2022.

* cited by examiner

*Primary Examiner* — Nael N Babaa
(74) *Attorney, Agent, or Firm* — Birch, Stewart, Kolasch & Birch, LLP

(57) ABSTRACT

A refrigeration system includes a first device, a second device communicably connected to the first device via a first cable and a second cable, and a refrigerant pipe configured to cause refrigerant circulation to the first device or the second device, in which the first device includes a first circuit configured to short-circuit the first cable and the second cable upon detection of abnormality relevant to refrigerant leakage, and the second device includes a second circuit configured to start protection behavior against abnormality when the first cable and the second cable are short-circuited.

10 Claims, 10 Drawing Sheets

REFRIGERATION SYSTEM

CROSS REFERENCE TO RELATED APPLICATIONS

This application is a Continuation of PCT International Application No. PCT/JP2022/006648, filed on Feb. 18, 2022, which claims priority under 35 U.S.C. 119 (a) to Patent Application No. 2021-038438, filed in Japan on Mar. 10, 2021, all of which are hereby expressly incorporated by reference into the present application.

TECHNICAL FIELD

The present disclosure relates to a refrigeration system.

BACKGROUND ART

There has been known a refrigeration system including an indoor unit and an outdoor unit, and configured to cause heat exchange with use of a refrigerant to condition air or execute refrigeration. The refrigeration system needs to execute protection behavior when the refrigerant leaks out of the refrigeration system.

For example, PATENT LITERATURE 1 discloses determination of whether or not a refrigerant leaks in accordance with a measurement value of a refrigerant detector installed in an indoor unit. Upon determination that the refrigerant leaks, the number of revolutions of an indoor fan may be controlled to be larger than the maximum number of revolutions during normal operation, or a compressor mounted on an outdoor unit may be stopped.

CITATION LIST

Patent Literature

PATENT LITERATURE 1: WO 2017/175300 A

SUMMARY

A refrigeration system according to the present disclosure includes: a first device: a second device communicably connected to the first device via a first cable and a second cable; and a refrigerant pipe configured to cause refrigerant circulation to the first device or the second device, in which the first device includes a first circuit configured to short-circuit the first cable and the second cable upon detection of abnormality relevant to refrigerant leakage, and the second device includes a second circuit configured to start protection behavior against abnormality when the first cable and the second cable are short-circuited.

DETAILED DESCRIPTION

Figure 1:
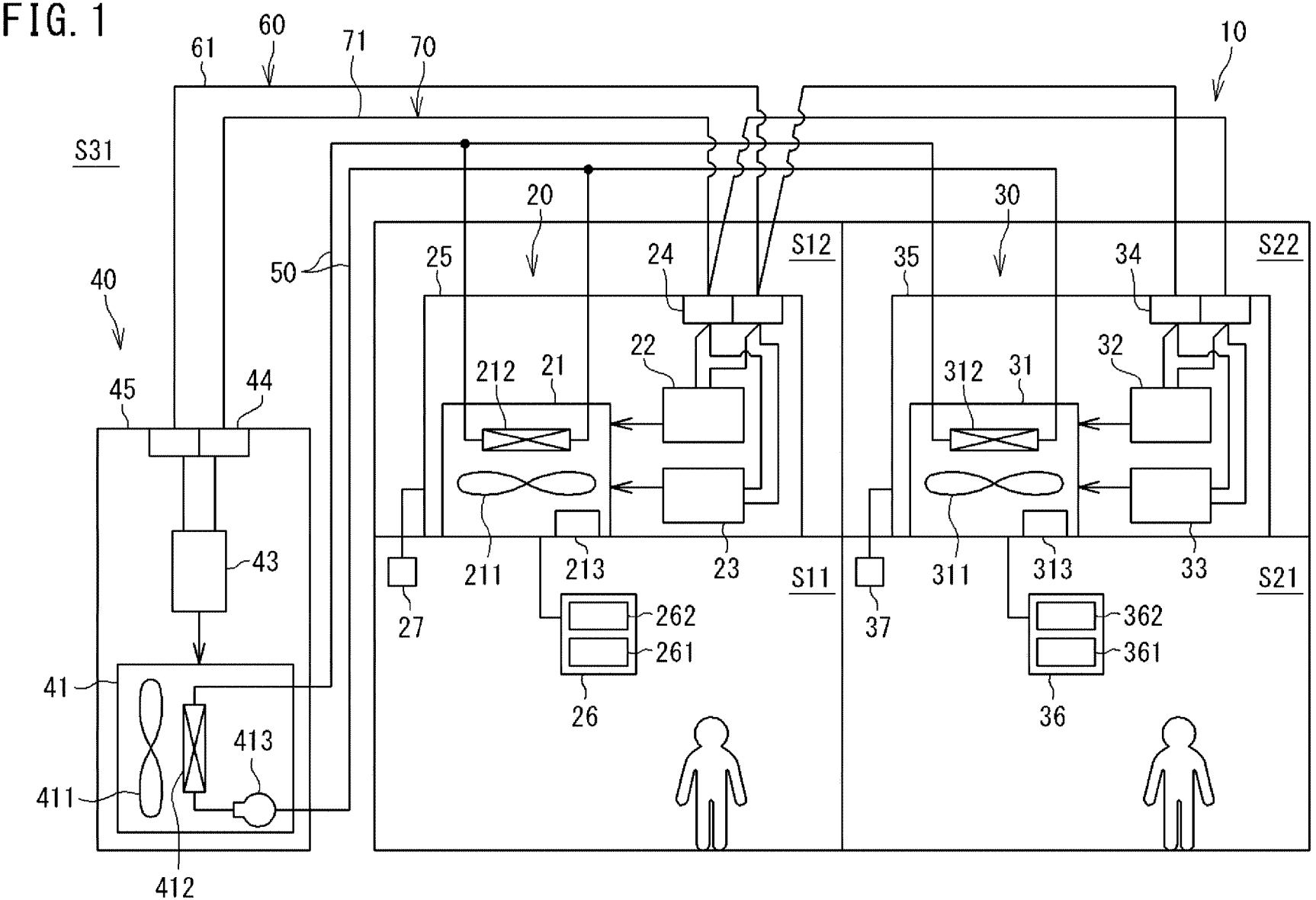
FIG. 1 is a diagram schematically depicting a configuration of a refrigeration system according to an embodiment.

Embodiments of the present disclosure will be described hereinafter with reference to the accompanying drawings.

Embodiments

[Outline of Refrigeration System]

When a first indoor unit 20 or a second indoor unit 30 comes into an abnormal state in a refrigeration system 10 according to an embodiment, a first cable 60 and a second cable 70 used as communication lines are short-circuited to achieve quicker notification of the abnormal state to a different device (e.g. an outdoor unit 40) connected to the first cable 60 and the second cable 70.

[Entire Configuration of Refrigeration System]

FIG. 1 is a diagram schematically depicting a configuration of the refrigeration system 10 according to the embodiment of the present disclosure.

Figure 2:
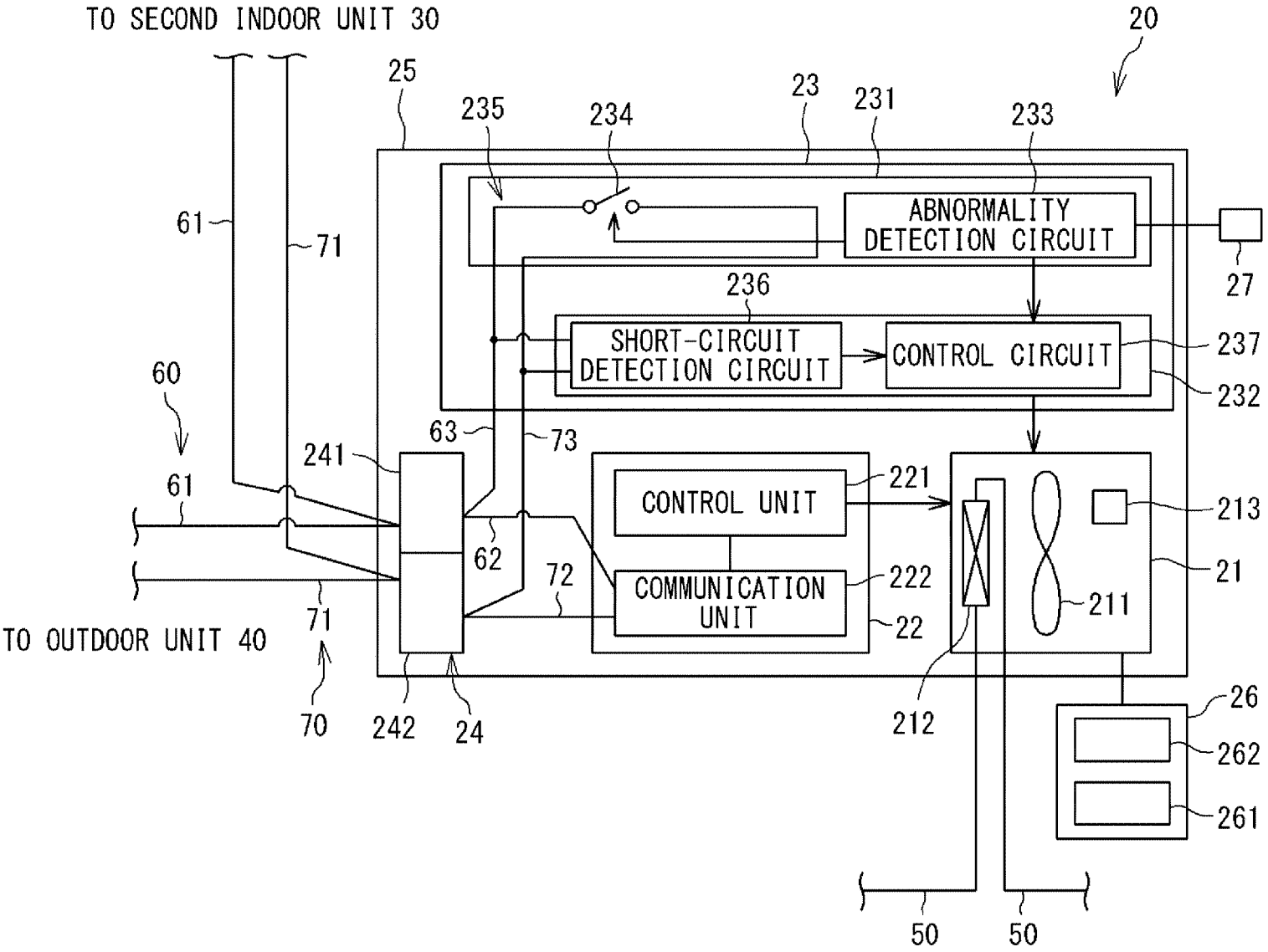
FIG. 2 is a diagram schematically depicting an internal configuration of a first indoor unit according to the embodiment.

FIG. 2 is a diagram schematically depicting an internal configuration of the first indoor unit 20 according to the embodiment of the present disclosure.

Figure 3:
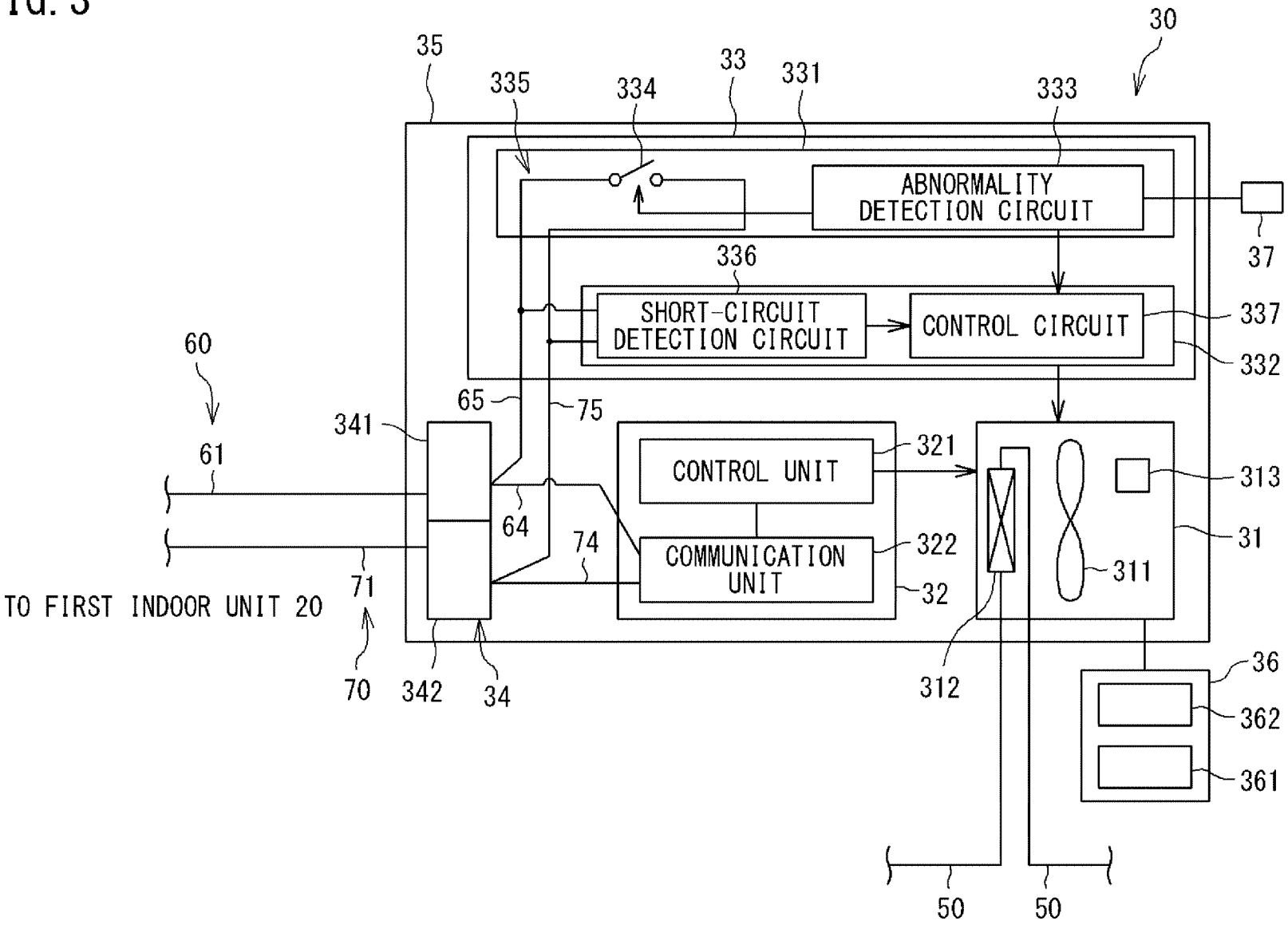
FIG. 3 is a diagram schematically depicting an internal configuration of a second indoor unit according to the embodiment.

FIG. 3 is a diagram schematically depicting an internal configuration of the second indoor unit 30 according to the embodiment of the present disclosure.

Figure 4:
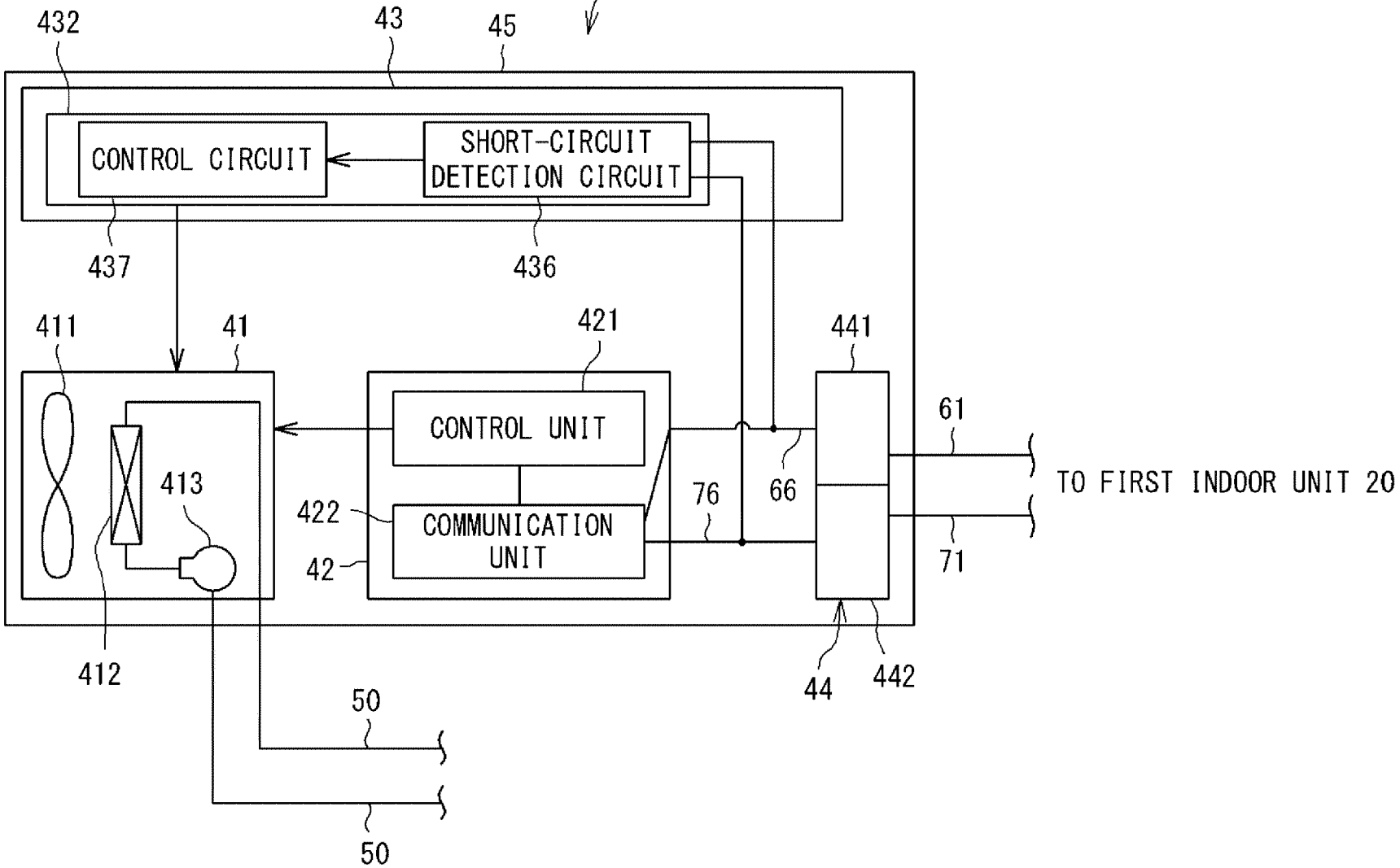
FIG. 4 is a diagram schematically depicting an internal configuration of an outdoor unit according to the embodiment.

FIG. 4 is a diagram schematically depicting an internal configuration of the outdoor unit 40 according to the embodiment of the present disclosure.

Refer to FIG. 1.

The refrigeration system 10 is configured to cause heat exchange with use of a refrigerant. Examples of the refrigeration system 10 include an air conditioner configured to adjust temperature in an indoor space, a refrigeration apparatus configured to refrigerate to store food or the like, and a cold storage apparatus configured to cool to store food and the like. The present embodiment representatively refers to the refrigeration system 10 functioning as an air conditioner.

The refrigeration system 10 includes the first indoor unit 20, the second indoor unit 30, the outdoor unit 40, a refrigerant pipe 50, the first cable 60, and the second cable 70. The first indoor unit 20 exemplifies a "first device" according to the present disclosure. The second indoor unit 30 exemplifies a "second device" according to the present disclosure. The outdoor unit 40 exemplifies the "second device" according to the present disclosure. The refrigeration system 10 may further include an indoor unit other than the first indoor unit 20 and the second indoor unit 30.

The first indoor unit 20 has a function of adjusting temperature in an indoor space S11. Examples of the first indoor unit 20 include an indoor unit of a ceiling embedded type. The first indoor unit 20 includes a case 25 to be described later, which is disposed in a ceiling space S12 positioned above the indoor space S11. The first indoor unit 20 may of a ceiling pendent type, a floorstanding type, or a wall mounted type. In this case, the case 25 is disposed in the indoor space S11.

The second indoor unit 30 has a function of adjusting temperature in an indoor space S21. The indoor space S21 is positioned in a room different from the indoor space S11. Examples of the second indoor unit 30 include an indoor unit of a ceiling embedded type. The second indoor unit 30 includes a case 35 to be described later, which is disposed in a ceiling space S22 positioned above the indoor space S21. The second indoor unit 30 may of a ceiling pendent type, a floorstanding type, or a wall mounted type. In this case, the case 35 is disposed in the indoor space S21.

The outdoor unit 40 is disposed in an outdoor space S31.

The refrigerant pipe 50 allows circulation of a refrigerant. The refrigerant pipe 50 connects a heat exchanger 212 to be described later in the first indoor unit 20, a heat exchanger 312 to be described later in the second indoor unit 30, and a heat exchanger 412 to be described later in the outdoor unit 40, to allow the refrigerant to circulate in the heat exchangers 212, 312, and 412.

The first cable 60 and the second cable 70 electrically connect the first indoor unit 20, the second indoor unit 30, and the outdoor unit 40. Each of the first cable 60 and the second cable 70 has a function of a communication line communicably connecting the first indoor unit 20, the second indoor unit 30, and the outdoor unit 40.

Specifically, the first indoor unit 20 transmits a communication signal to each of the first cable 60 and the second cable 70 to communicate with the second indoor unit 30 and the outdoor unit 40. The second indoor unit 30 transmits a communication signal to each of the first cable 60 and the second cable 70 to communicate with the first indoor unit 20 and the outdoor unit 40. The outdoor unit 40 transmits a communication signal to each of the first cable 60 and the second cable 70 to communicate with the first indoor unit 20 and the second indoor unit 30.

As depicted in FIG. 1 to FIG. 4, the first cable 60 has an outer region 61 and three inner regions 62, 64, and 66. The outer region 61 has connection among first terminals 241, 341, and 441 to be described later. The three inner regions 62, 64, and 66 have connection between the first terminals 241, 341, and 441 and control boards 22, 32, and 42 to be described later.

As depicted in FIG. 1 to FIG. 4, the second cable 70 has an outer region 71 and three inner regions 72, 74, and 76. The outer region 71 has connection among second terminals 242, 342, and 442 to be described later. The three inner regions 72, 74, and 76 have connection between the second terminals 242, 342, and 442 and the control boards 22, 32, and 42 to be described later.

The present embodiment provides two cables (the first cable 60 and the second cable 70) serving as communication lines. There may alternatively be provided three or more cables as communication lines. In this case, appropriate two out of the three or more cables will be referred to as the first cable 60 and the second cable 70.

[Configuration of First Indoor Unit]

Refer to FIG. 1 and FIG. 2.

The first indoor unit 20 includes an operation unit 21, a control board 22, a protection board 23, a terminal block 24, the case 25, a remote controller 26, and a sensor 27. The case 25 accommodates part of the operation unit 21, the control board 22, the protection board 23, and the terminal block 24.

The remote controller 26 and the sensor 27 are disposed outside the case 25. The remote controller 26 and the sensor 27 are disposed in the indoor space S11 in the present embodiment. Alternatively, the sensor 27 may be disposed in the ceiling space S12 or in the case 25.

The remote controller 26 is wiredly or wirelessly connected to the control board 22 and the protection board 23. The remote controller 26 includes a display unit 261 and an input unit 262. The display unit 261 includes an LED, a liquid crystal panel, and the like. The display unit 261 displays, to a user, states (e.g. current set temperature, airflow volume, airflow direction, details of an error occurring in the refrigeration system 10) of the refrigeration system 10 in accordance with a command from a control unit 221 or a control circuit 237 to be described later. The input unit 262 includes a button operated by a user to set temperature, airflow volume, airflow direction, or the like. Upon receipt of input by a user, the input unit 262 transmits the input to the control board 22 or the protection board 23.

The operation unit 21 includes a fan 211, a heat exchanger 212, a display unit 213, a first ventilator (not depicted), and a first shutoff valve (not depicted). The case 25 accommodates the fan 211 and the heat exchanger 212. The case 25 accommodates the display unit 213 in a state where a user of the indoor space S11 can see display. The first ventilator and the first shutoff valve are disposed outside the case 25.

The fan 211 imports air in the indoor space S11 into the case 25, and supplies the indoor space S11 with air (conditioned air) obtained through heat exchange caused by the heat exchanger 212 in the case 25. The heat exchanger 212 is exemplarily of a cross-fin tube type. The heat exchanger 212 is connected with the refrigerant pipe 50.

The display unit 213 includes an LED, a liquid crystal panel, and the like, and is configured to display the states of the refrigeration system 10 to a user. For example, the display unit 213 may light a green LED in order to indicate normal operation, or may flicker a yellow LED in order to indicate an error of the refrigeration system 10. The display unit 213 may further display a state of the first indoor unit 20 in the liquid crystal panel.

The first ventilator (not depicted) is configured to discharge air in the indoor space S11 into the outdoor space S31, and includes a fan. The first ventilator is exemplarily provided on a wall separating the indoor space S11 and the outdoor space S31.

The first shutoff valve (not depicted) is configured to control circulation in the refrigerant pipe 50 upstream of the heat exchanger 212 or the like. The first shutoff valve is opened constantly, and allow the refrigerant to flow into the heat exchanger 212 via the refrigerant pipe 50. When the first shutoff valve closes, the heat exchanger 212 is separated from the refrigerant pipe 50 to stop a flow of the refrigerant from the refrigerant pipe 50 into the first indoor unit 20. The first shutoff valve is provided in the ceiling space S12 or the like.

The terminal block 24 is a component connecting the first cable 60 and the second cable 70 to each component in the case 25. The terminal block 24 includes the first terminal 241 and the second terminal 242. The first terminal 241 is connected with the first cable 60. The second terminal 242 is connected with the second cable 70.

The control board 22 is configured to control normal behavior of the first indoor unit 20, and includes the control unit 221 and a communication unit 222. The control board 22 is equipped with an arithmetic device such as a microprocessor, and a storage device such as a memory IC. Each of the control unit 221 and the communication unit 222 is embodied when the arithmetic device reads a program preliminarily stored in the storage device.

The control board 22 is connected with the first cable 60 and the second cable 70. Specifically, the first cable 60 (the inner region 62) is connected between the first terminal 241 and the control board 22, and the second cable 70 (the inner region 72) is connected between the second terminal 242 and the control board 22. The communication unit 222 receives communication signals flowing in the first cable 60 and the second cable 70.

The control unit 221 controls behavior of the operation unit 21 in accordance with the preliminarily stored program and information inputted through the communication unit 222. The control unit 221 controls the number of revolutions of the fan 211, display on the display unit 213, and the like. The control unit 221 also controls display on the display unit 261 of the remote controller 26.

The communication unit 222 communicates with a different device (e.g. the second indoor unit 30 or the outdoor unit 40) included in the refrigeration system 10. The communication unit 222 converts a communication signal constituted by a potential difference between the first cable 60 and the second cable 70 to a digital signal, and transmits, to the control unit 221, the digital signal as information inputted through a different device. The communication unit 222 further converts the digital signal outputted from the control unit 221 to a communication signal and transmits the communication signal to the first cable 60 and the second cable 70.

The protection board 23 is provided separately from the control board 22, and is configured to control behavior for protection of the first indoor unit 20. The protection board 23 includes the first circuit 231 and a fourth circuit 232. Each of the first circuit 231 and the fourth circuit 232 does not include any arithmetic device such as a microprocessor, and is constituted only by hardware.

The first circuit 231 is configured to short-circuit the first cable 60 and the second cable 70 upon detection of abnormality in the first indoor unit 20. The first circuit 231 includes an abnormality detection circuit 233, and a short circuit 235.

The abnormality detection circuit 233 is configured to detect abnormality relevant to refrigerant leakage. The abnormality detection circuit 233 is electrically connected to the sensor 27, the short circuit 235, and the control circuit 237. The abnormality detection circuit 233 detects abnormality relevant to refrigerant leakage in accordance with a detection signal of the sensor 27. The sensor 27 will be described later in terms of its configuration.

Examples of abnormality relevant to refrigerant leakage include refrigerant leakage from the refrigerant pipe 50, trouble of the sensor 27 configured to detect refrigerant leakage, and a life cycle of the sensor 27. The abnormality detection circuit 233 detecting abnormality relevant to refrigerant leakage transmits a predetermined electric signal to each of the short circuit 235 and control circuit 237.

The short circuit 235 includes a cable 63, a cable 73, and a switch 234. The cable 63 has a first end connected to the first terminal 241, and a second end connected to a first side of the switch 234. The first end of the cable 63 may alternatively be connected the inner region 62 of the first cable 60. The cable 73 has a first end connected to the second terminal 242, and a second end connected to a second side of the switch 234. The first end of the cable 73 may alternatively be connected the inner region 72 of the second cable 70. In such a configuration, the switch 234 is connected parallelly to the first cable 60 and the second cable 70 via the cable 63 and the cable 73.

The switch 234 is constantly in an opened state. When the abnormality detection circuit 233 detects abnormality relevant to refrigerant leakage, a predetermined electric signal is transmitted from the abnormality detection circuit 233 to the short circuit 235. The switch 234 is turned from the opened state into a connected state in accordance with the predetermined electric signal. The first cable 60 and the second cable 70 are thus electrically connected to each other via the cable 63, the switch 234, and the cable 73 by electrical resistance lower than a normal level (the first cable 60 and the second cable 70 are short-circuited by the short circuit 235).

Each of the cable 63 and the cable 73 may include a resistive element having low resistance. Also in such a configuration, the first cable 60 and the second cable 70 are short-circuited when the switch 234 is turned into the connected state. The present disclosure refers to "short-circuit" including a case where the first cable 60 and the second cable 70 are electrically connected by electrical resistance substantially equal to zero, and a case where the first cable 60 and the second cable 70 are electrically connected via the resistive element having low resistance. In any one of the cases, large current, which does not flow upon normal communication, flows between the first cable 60 and the second cable 70.

The fourth circuit 232 is configured to start protection behavior for the first indoor unit 20 when the first cable 60 and the second cable 70 are short-circuited. The fourth circuit 232 includes a short-circuit detection circuit 236, and a control circuit 237.

The short-circuit detection circuit 236 is configured to detect short-circuit between the first cable 60 and the second cable 70. The short-circuit detection circuit 236 has a first end connected to the cable 63 and a second end connected to the cable 73. Alternatively in the short-circuit detection circuit 236, the first end may be connected to the inner region 62 of the first cable 60 and the second end may be connected to the inner region 72 of the second cable 70. Furthermore, the short-circuit detection circuit 236 is electrically connected to the control circuit 237.

The short-circuit detection circuit 236 is exemplarily configured to detect a potential difference between the first cable 60 and the second cable 70. When the potential difference is less than a predetermined lower limit value continuously for a predetermined time period (e.g. longer than a 0 V output time period of a normal communication signal), the short-circuit detection circuit 236 assumes that the first cable 60 and the second cable 70 are short-circuited and transmits a predetermined electric signal to the control circuit 237.

The short-circuit detection circuit 236 may alternatively be configured to detect a current value of at least one of the first cable 60 and the second cable 70 (as an overcurrent detection circuit). In this case, the short-circuit detection circuit 236 includes a current sensor inserted to at least one of the first cable 60 and the second cable 70. When the current sensor detects a current value exceeding a predetermined upper limit value, the short-circuit detection circuit 236 assumes that the first cable 60 and the second cable 70 are short-circuited and transmits a predetermined electric signal to the control circuit 237.

The control circuit 237 is electrically connected to the operation unit 21. When the short-circuit detection circuit 236 detects short-circuit between the first cable 60 and the second cable 70, a predetermined electric signal is transmitted from the short-circuit detection circuit 236 to the control circuit 237. When the control circuit 237 receives the predetermined electric signal, the control circuit 237 controls the operation unit 21, and causes the operation unit 21 to execute protection behavior against abnormality.

The protection behavior to be executed by the operation unit 21 includes abnormality inhibiting behavior and abnormality notifying behavior. The abnormality inhibiting behavior includes behavior for recovering the refrigeration system 10 from an abnormal state to a normal state or preventing further deterioration of the abnormal state of the refrigeration system 10. The abnormality notifying behavior includes behavior for notifying a user of abnormality of the refrigeration system 10.

The abnormality inhibiting behavior includes rotating the fan 211 so as to have the maximum number of revolutions. The abnormality inhibiting behavior further includes operating the first ventilator (not depicted) so as to have the maximum airflow volume. Such behavior causes any leaked refrigerant to spread quickly so as to prevent local increase in refrigerant concentration. Rotation of the fan 211 or behavior of the first ventilator may be continued for a preset time period or the like, or may be continued until the abnormality detection circuit 233 detects no more abnormality.

When the abnormality inhibiting behavior includes rotation of the fan 211 or behavior of the first ventilator, the abnormality inhibiting behavior may further include stopping reception of any input from the input unit 262 of the remote controller 26. In this case, any input to the input unit 262 will not be transmitted to the control unit 221. This behavior avoids a situation where other protection behavior such as rotating the fan 211 is stopped earlier before the preset time period elapses.

When stopping reception of any input from the input unit 262, the display unit 261 of the remote controller 26 may display "unable to input" or the like when a user presses the button of the input unit 262 in order to notify the user that the input is invalid.

The abnormality inhibiting behavior includes closing the first shutoff valve (not depicted) provided on the refrigerant pipe 50. Such behavior stops the flow of the refrigerant from the refrigerant pipe 50 into the first indoor unit 20, for inhibition of further refrigerant leakage.

The abnormality notifying behavior includes display of refrigerant leakage on the display unit 213 by means of light or sound. In this case, the LED in the display unit 213 may be flickered in a color (e.g. yellow or red) different from a color during normal operation, the liquid crystal panel in the display unit 213 may display refrigerant leakage by means of letters, or a speaker included in the display unit 213 may output alert sound.

The abnormality notifying behavior includes display of refrigerant leakage on the display unit 261 of the remote controller 26 by means of light or sound. Such behavior can achieve notification of refrigerant leakage to a user.

The sensor 27 is configured to detect refrigerant leakage. The sensor 27 is electrically connected to the abnormality detection circuit 233. The sensor 27 is configured to detect refrigerant concentration or the like, and transmits the refrigerant concentration thus detected as a detection signal to the abnormality detection circuit 233. For example, the detection signal of the sensor 27 exceeding a predetermined upper limit value indicates that the refrigerant leaks to exceed prescribed concentration. When the abnormality detection circuit 233 receives such a detection signal exceeding the predetermined upper limit value from the sensor 27, the abnormality detection circuit 233 detects abnormality of refrigerant leakage.

The detection signal of the sensor 27 less than a predetermined lower limit value (e.g. the value of the detection signal of the sensor 27 is zero) continuously for a predetermined time period indicates that the sensor 27 is in trouble and does not have correct output. When the abnormality detection circuit 233 receives such a detection signal less than the predetermined lower limit value from the sensor 27 (or receives no detection signal), the abnormality detection circuit 233 detects trouble of the sensor 27.

The sensor 27 may be configured to directly detect refrigerant concentration, or may be configured to indirectly detect refrigerant concentration. Examples of the sensor 27 configured to indirectly detect refrigerant concentration include a carbon dioxide sensor and an oxygen concentration sensor. Upon refrigerant leakage, gas normally contained in the air has concentration relatively decreased due to increase in refrigerant concentration in the air. Decrease in concentration of the gas normally contained in the air is detected by the sensor 27, to achieve indirect detection of increase in refrigerant concentration.

When the sensor 27 is configured to detect oxygen concentration, the sensor 27 transmits the oxygen concentration thus detected as a detection signal to the abnormality detection circuit 233. For example, the detection signal of the sensor 27 less than the predetermined lower limit value indicates that oxygen is less than prescribed concentration, so that it is estimated that the refrigerant leaks to exceed the prescribed concentration. When the abnormality detection circuit 233 receives such a detection signal less than the predetermined lower limit value from the sensor 27 (oxygen concentration sensor), the abnormality detection circuit 233 detects abnormality of refrigerant leakage.

The sensor 27 may alternatively be a pressure sensor provided on the refrigerant pipe 50. The sensor 27 detects refrigerant pressure in the refrigerant pipe 50, and transmits the pressure thus detected as a detection signal to the abnormality detection circuit 233. Refrigerant pressure in the refrigerant pipe 50 decreases upon refrigerant leakage. In an exemplary case where the detection signal of the sensor 27 is less than the predetermined lower limit value, the abnormality detection circuit 233 detects abnormality of refrigerant leakage assuming that a refrigerant exceeding predetermined volume leaks from the refrigerant pipe 50.

The abnormality detection circuit 233 may optionally be provided therein with a counter. The counter is configured to count an electrification time period between the sensor 27 and the abnormality detection circuit 233, and record an integrated value of the electrification time period. When the integrated value exceeds a predetermined upper limit value, the abnormality detection circuit 233 detects abnormality assuming that the sensor 27 has reached the life cycle due to aged deterioration. The predetermined upper limit value may be set shorter than the actual life cycle of the sensor 27 due to aged deterioration for safety. When the aged sensor 27 is replaced with a new sensor 27, the integrated value of the electrification time period is reset on the counter of the abnormality detection circuit 233.

[Configuration of Second Indoor Unit]

Refer to FIG. 1 and FIG. 3.

The second indoor unit 30 includes an operation unit 31, a control board 32, a protection board 33, a terminal block 34, the case 35, a remote controller 36, and a sensor 37. These components are configured similarly to the operation unit 21, the control board 22, the protection board 23, the terminal block 24, the case 25, the remote controller 26, and the sensor 27 in the first indoor unit 20. The second indoor unit 30 will not be described repeatedly where appropriate in terms of components configured similarly to the components of the first indoor unit 20.

The remote controller 36 and the sensor 37 are disposed in the indoor space S21 in the present embodiment. Alternatively, the sensor 37 may be disposed in the ceiling space S22 or in the case 35.

The remote controller 36 includes a display unit 361 and an input unit 362. The display unit 361 and the input unit 362 are configured similarly to the display unit 261 and the input unit 262, respectively.

The operation unit 31 includes a fan 311, a heat exchanger 312, a display unit 313, a second ventilator (not depicted), and a second shutoff valve (not depicted). These components are configured similarly to the fan 211, the heat exchanger 212, the display unit 213, the first ventilator (not depicted), and the first shutoff valve (not depicted).

The fan 311 imports air in the indoor space S21 into the case 35, and supplies the indoor space S21 with air (conditioned air) obtained through heat exchange caused by the heat exchanger 312 in the case 35. The second ventilator (not depicted) is configured to discharge air in the indoor space S21 into the outdoor space S31, and includes a fan. The second ventilator is exemplarily provided on a wall separating the indoor space S21 and the outdoor space S31. The second shutoff valve is provided in the ceiling space S22 or the like.

The terminal block 34 includes the first terminal 341 and the second terminal 342. These components are configured similarly to the first terminal 241 and the second terminal 242.

The control board 32 is configured to control normal behavior of the second indoor unit 30, and includes a control unit 321 and a communication unit 322. These components are configured similarly to the control unit 221 and the communication unit 222. The control board 32 is connected with the first cable 60 and the second cable 70. Specifically, the first cable 60 (the inner region 64) is connected between the first terminal 341 and the control board 32, and the second cable 70 (the inner region 74) is connected between the second terminal 342 and the control board 32. The communication unit 322 communicates with a different device (e.g. the first indoor unit 20 or the outdoor unit 40) included in the refrigeration system 10.

The protection board 33 includes a third circuit 331 and a second circuit 332. Each of the third circuit 331 and the second circuit 332 is constituted only by hardware. The third circuit 331 is configured similarly to the first circuit 231, and the second circuit 332 is configured similarly to the fourth circuit 232.

The third circuit 331 includes an abnormality detection circuit 333, and a short circuit 335. The short circuit 335 includes a cable 65, a cable 75, and a switch 334. These components are configured similarly to the abnormality detection circuit 233, the short circuit 235, the cable 63, the cable 73, and the switch 234.

The second circuit 332 is configured to start protection behavior for the second indoor unit 30 when the first cable 60 and the second cable 70 are short-circuited. The second circuit 332 includes a short-circuit detection circuit 336, and a control circuit 337. These components are configured similarly to the short-circuit detection circuit 236 and the control circuit 237.

[Configuration of Outdoor Unit]

Refer to FIG. 1 and FIG. 4.

The outdoor unit 40 includes an operation unit 41, a control board 42, a protection board 43, a terminal block 44, and a case 45. These components are configured similarly to the operation unit 21, the control board 22, the protection board 23, the terminal block 24, and the case 25 in the first indoor unit 20. The outdoor unit 40 will not be described repeatedly where appropriate in terms of components configured similarly to the components of the first indoor unit 20.

The operation unit 41 includes a fan 411, a heat exchanger 412, and a third shutoff valve (not depicted). These components are configured similarly to the fan 211, the heat exchanger 212, and the first shutoff valve (not depicted). The operation unit 41 further includes a compressor 413 configured to compress a refrigerant. The compressor 413 is connected to the refrigerant pipe 50.

The fan 411 imports air in the outdoor space S31 into the case 45, and discharges, to the outdoor space S31, air obtained through heat exchange caused by the heat exchanger 412 in the case 45. The third shutoff valve is provided in the case 45 or the like.

The terminal block 44 includes the first terminal 441 and the second terminal 442. These components are configured similarly to the first terminal 241 and the second terminal 242.

The control board 42 is configured to control normal behavior of the outdoor unit 40, and includes a control unit 421 and a communication unit 422. These components are configured similarly to the control unit 221 and the communication unit 222. The control board 42 is connected with the first cable 60 and the second cable 70. Specifically, the first cable 60 (the inner region 66) is connected between the first terminal 441 and the control board 42, and the second cable 70 (the inner region 76) is connected between the second terminal 442 and the control board 42. The communication unit 422 communicates with a different device (e.g. the first indoor unit 20 or the second indoor unit 30) included in the refrigeration system 10.

The protection board 43 includes a second circuit 432. The second circuit 432 is constituted only by hardware. The second circuit 432 is configured similarly to the fourth circuit 232.

The second circuit 432 is configured to start protection behavior for the outdoor unit 40 when the first cable 60 and the second cable 70 are short-circuited. The second circuit 432 includes a short-circuit detection circuit 436, and a control circuit 437.

The short-circuit detection circuit 436 is configured to detect short-circuit between the first cable 60 and the second cable 70. The short-circuit detection circuit 436 has a first end connected to the inner region 66 and a second end connected to the inner region 76. Furthermore, the short-circuit detection circuit 436 is electrically connected to the control circuit 437.

The short-circuit detection circuit 436 is exemplarily configured to detect a potential difference between the first cable 60 and the second cable 70. When the potential difference is less than a predetermined lower limit value continuously for a predetermined time period, the short-circuit detection circuit 436 assumes that the first cable 60 and the second cable 70 are short-circuited and transmits a predetermined electric signal to the control circuit 437.

The short-circuit detection circuit 436 may alternatively be configured to detect a current value of at least one of the first cable 60 and the second cable 70 (as an overcurrent detection circuit). When the current value exceeds a predetermined upper limit value, the short-circuit detection circuit 436 assumes that the first cable 60 and the second cable 70 are short-circuited and transmits a predetermined electric signal to the control circuit 437.

The control circuit 437 is electrically connected to the operation unit 41. When the short-circuit detection circuit 436 detects short-circuit between the first cable 60 and the second cable 70, a predetermined electric signal is transmitted from the short-circuit detection circuit 436 to the control circuit 437. When the control circuit 437 receives the predetermined electric signal, the control circuit 437 controls the operation unit 41, and causes the operation unit 41 to execute protection behavior against abnormality.

The protection behavior to be executed by the operation unit 41 includes abnormality inhibiting behavior. The abnormality inhibiting behavior includes behavior for recovering the refrigeration system 10 from an abnormal state to a normal state or preventing further deterioration of the abnormal state of the refrigeration system 10.

The abnormality inhibiting behavior includes stopping the compressor 413. The abnormality inhibiting behavior further includes closing the third shutoff valve (not depicted). Such behavior stops refrigerant circulation in the refrigerant pipe 50, for inhibition of further refrigerant leakage.

The abnormality inhibiting behavior further includes interlocking the outdoor unit 40 after stopping the compressor 413 and closing the third shutoff valve. In this case, the compressor 413 is not activated and the third shutoff valve is not opened in the outdoor unit 40 unless a predetermined input condition is satisfied. Such behavior prevents unintended restart of the compressor 413 and the like during continuation of the abnormal state such as refrigerant leakage.

[Protection Method in Refrigeration System]

Described with appropriate reference to FIG. 1 to FIG. 5 is a protection method in the refrigeration system 10.

Figure 5:
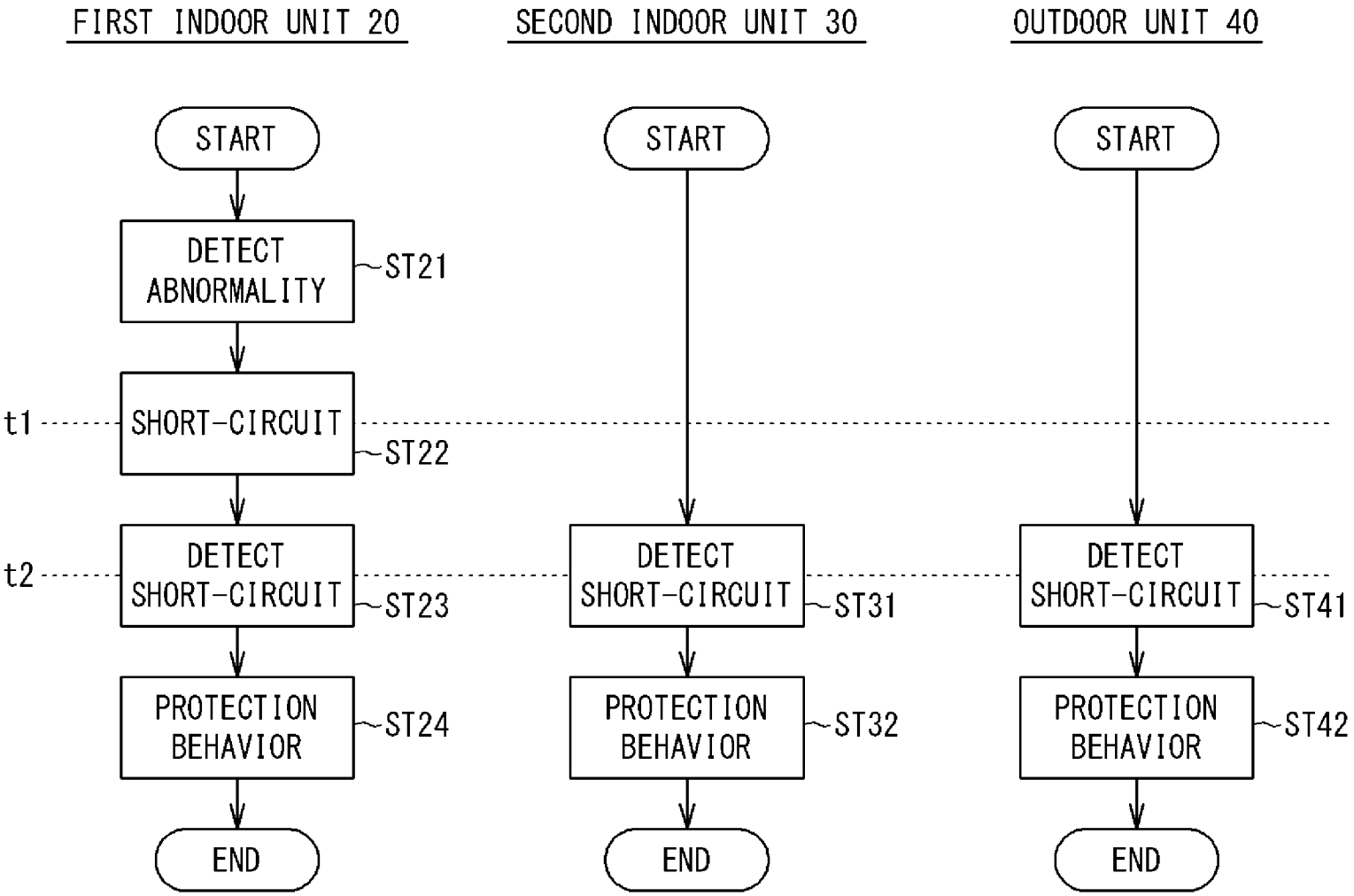
FIG. 5 is a flowchart exemplifying a protection method according to an embodiment.

FIG. 5 is a flowchart exemplifying a protection method in the refrigeration system 10.

Initially described is behavior of the first indoor unit 20.

Assume an exemplary case where the refrigerant leaks from a portion of the refrigerant pipe 50 connected with the first indoor unit 20 (e.g. a joint of the pipe) into the ceiling space S12 and the indoor space S11. In this case, the sensor 27 initially detects the refrigerant and transmits a detection signal to the abnormality detection circuit 233. When the detection signal exceeds the predetermined upper limit value, the abnormality detection circuit 233 detects abnormality relevant to refrigerant leakage assuming that the refrigerant leaks to exceed the prescribed concentration, and transmits a predetermined electric signal to the short circuit 235 and the control circuit 237 (abnormality detection step ST 21).

The switch 234 is turned from the opened state into the connected state when the short circuit 235 receives the predetermined electric signal from the abnormality detection circuit 233. This leads to short-circuit between the first cable 60 and the second cable 70 (short-circuiting step ST22).

The short-circuit detection circuit 236 subsequently detects short-circuit between the first cable 60 and the second cable 70, and transmits a predetermined electric signal to the control circuit 237 (short-circuit detection step ST23).

When the control circuit 237 receives the predetermined electric signal, the control circuit 237 causes the operation unit 21 to execute protection behavior against abnormality (protection behavior step ST24).

The control circuit 237 may cause the operation unit 21 to execute protection behavior against abnormality at any earlier timing when receiving the predetermined electric signal from the abnormality detection circuit 233 or when receiving the predetermined electric signal from the short-circuit detection circuit 236. Such a configuration enables execution of protection behavior step ST24 readily after abnormality detection step ST21 in the first indoor unit 20 having abnormality. Accordingly, short-circuit step ST22 and short-circuit detection step ST23 can be skipped for quicker start of protection behavior against abnormality.

Described next is behavior of the second indoor unit 30.

The second indoor unit 30 is connected to the first cable 60 and the second cable 70. If the first cable 60 and the second cable 70 are short-circuited at first time t1 in short-circuit step ST22, the short-circuit detection circuit 336 in the second indoor unit 30 detects short-circuit between the first cable 60 and the second cable 70 at second time t2 after the first time t1, and transmits a predetermined electric signal to the control circuit 337 (short-circuit detection step ST31).

When the control circuit 337 receives the predetermined electric signal, the control circuit 337 causes the operation unit 31 to execute protection behavior against abnormality (protection behavior step ST32).

Described next is behavior of the outdoor unit 40.

The outdoor unit 40 is connected to the first cable 60 and the second cable 70. If the first cable 60 and the second cable 70 are short-circuited at the first time t1 in short-circuit step ST22, the short-circuit detection circuit 436 in the outdoor unit 40 detects short-circuit between the first cable 60 and the second cable 70 at the second time t2 after the first time t1, and transmits a predetermined electric signal to the control circuit 437 (short-circuit detection step ST41).

When the control circuit 437 receives the predetermined electric signal, the control circuit 437 causes the operation unit 41 to execute protection behavior against abnormality (protection behavior step ST42).

[Comparison with Conventional Protection Method]

Described hereinafter is a conventional protection method. When abnormality relevant to refrigerant leakage occurs and the first indoor unit 20 detects the abnormality, the first indoor unit 20 conventionally transmits a communication signal to the first cable 60 and the second cable 70 serving as communication lines, to notify the second indoor unit 30 and the outdoor unit 40 of the abnormality.

More specifically, when abnormality such as refrigerant leakage is detected in the first indoor unit 20, the abnormality detection circuit 233 transmits, to the control unit 221, an electric signal for abnormality notification. The control unit 221 generates a predetermined digital signal (e.g. an error code) for abnormality notification to a different device (e.g. each of the second indoor unit 30 and the outdoor unit 40), and transmits the digital signal to the communication unit 222. The communication unit 222 converts the digital signal to a communication signal and transmits the communication signal to the first cable 60 and the second cable 70.

In the second indoor unit 30, the communication unit 322 converts the communication signal received from each of the first cable 60 and the second cable 70 to a digital signal, and transmits, to the control unit 321, the digital signal thus converted. The control unit 321 analyzes the digital signal thus received, to determine a type of the error (refrigerant leakage in this exemplary case) and cause the operation unit 31 to execute protection behavior.

As described above, according to the conventional protection method, abnormality is notified from the abnormality detection circuit 233 in the first indoor unit 20 to the control unit 321 in the second indoor unit 30 via the control unit 221, the communication unit 222, the first cable 60 and the second cable 70, and the communication unit 322 in the mentioned order. Accordingly, both a device having detected abnormality (e.g. the first indoor unit 20) and a device notified of abnormality (e.g. the second indoor unit 30) need processing (signal generation or analysis) in the control units 221 and 321 and signal conversion in the communication units 222 and 322. Such processing includes calculation in the arithmetic device such as a microprocessor, so that abnormality notification from one device to another device takes a time period like about one minute.

In contrast, in the refrigeration system 10 according to the present embodiment, the first indoor unit 20 includes the short circuit 235 that short-circuits the first cable 60 and the second cable 70 serving as communication lines when the abnormality detection circuit 233 detects abnormality. When the short-circuit detection circuits 336 and 436 in the second indoor unit 30 and the outdoor unit 40 detects short-circuit, the control circuits 337 and 437 cause the operation units 31 and 41 to execute protection behavior.

Such a series of behavior does not include calculation such as generation of an error code or conversion of a communication signal. Abnormality is notified in accordance with a simple standard regarding whether or not there is a predetermined electric signal. It accordingly shortens, to 30 seconds or less, the time period from abnormality detection by the abnormality detection circuit 233 in the first indoor unit 20 to start of protection behavior by the operation units 31 and 41, enabling quicker abnormality notification than the conventional case.

In the refrigeration system 10, the protection board 23 is provided separately from the control board 22. Such a configuration enables more reliable protection behavior even when the control board 22 has any abnormality. The control unit 221 of the control board 22 may be configured to be communicable with each component (e.g. the control circuit 237) of the protection board 23. In this case, the control board 22 and the protection board 23 are provided separately from each other. When the protection board 23 has any abnormality, the control board 22 can thus detect the abnormality of the protection board 23 in accordance with incommunicability with the protection board 23. When the control board 22 detects abnormality of the protection board 23, the control unit 221 causes the operation unit 21 to execute protection behavior, and notifies a different device (e.g. the second indoor unit 30) of the abnormality via the communication unit 222.

Provision of the control board 22 and the protection board 23 separately from each other enables protection behavior by the operation unit 21 and abnormality notification to a different device even if any of the control board 22 and the protection board 23 has abnormality. This enhances reliability of protection behavior and abnormality notification in the refrigeration system 10.

Modification Examples

The present disclosure should not be limited to the embodiment described above, and can be modified variously. In the following modification examples, components configured similarly to the components according to the above embodiment will be denoted by identical reference signs and will not be described repeatedly where appropriate.

[Protection Method in Refrigeration System According to Modification Example]

Figure 6:
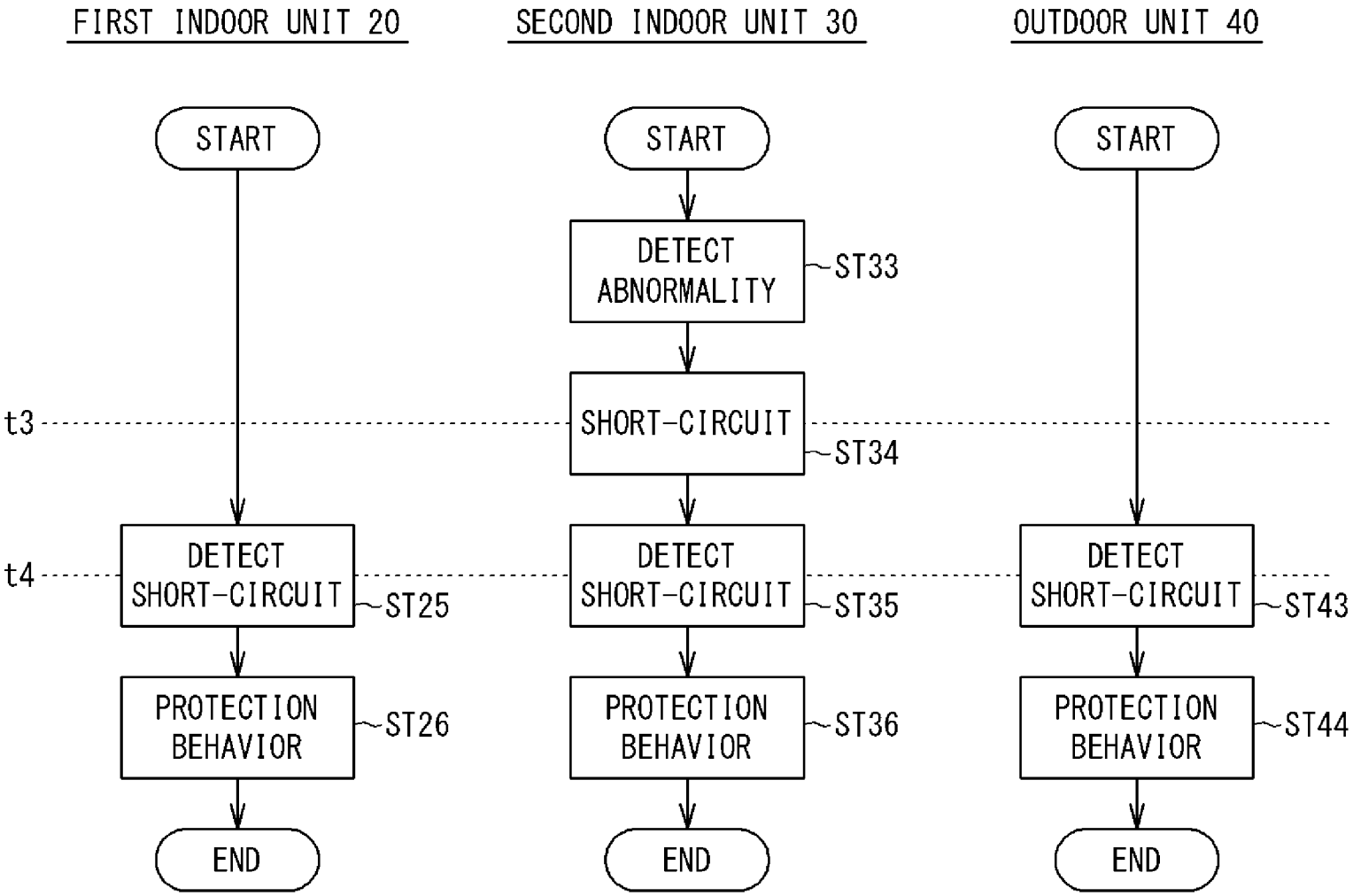
FIG. 6 is a flowchart exemplifying another protection method according to an embodiment.

FIG. 6 is a flowchart exemplifying a protection method in the refrigeration system 10 according to a modification example.

FIG. 5 relates to a case where the first indoor unit 20 detects abnormality. FIG. 6 relates to a case where the second indoor unit 30 detects abnormality.

Initially described is behavior of the second indoor unit 30.

Assume an exemplary case where the refrigerant leaks from a portion of the refrigerant pipe 50 connected with the second indoor unit 30 (e.g. a joint of the pipe) into the ceiling space S22 and the indoor space S21. In this case, the sensor 37 initially detects the refrigerant and transmits a detection signal to the abnormality detection circuit 333. When the detection signal exceeds the predetermined upper limit value, the abnormality detection circuit 333 detects abnormality of the second indoor unit 30 assuming that the refrigerant leaks to exceed the prescribed concentration, and transmits a predetermined electric signal to the short circuit 335 and the control circuit 337 (abnormality detection step ST 33).

The switch 334 is turned from the opened state into the connected state when the short circuit 335 receives the predetermined electric signal from the abnormality detection circuit 333. This leads to short-circuit between the first cable 60 and the second cable 70 (short-circuiting step ST34).

The short-circuit detection circuit 336 subsequently detects short-circuit between the first cable 60 and the second cable 70, and transmits a predetermined electric signal to the control circuit 337 (short-circuit detection step ST35).

When the control circuit 337 receives the predetermined electric signal, the control circuit 337 causes the operation unit 31 to execute protection behavior against abnormality (protection behavior step ST36).

The control circuit 337 may cause the operation unit 31 to execute protection behavior against abnormality at any earlier timing when receiving the predetermined electric signal from the abnormality detection circuit 333 or when receiving the predetermined electric signal from the short-circuit detection circuit 336. Such a configuration enables execution of protection behavior step ST36 readily after abnormality detection step ST33 in the second indoor unit 30 having abnormality. Accordingly, short-circuit step ST34 and short-circuit detection step ST35 can be skipped for quicker start of protection behavior against abnormality.

Described next is behavior of the first indoor unit 20.

The first indoor unit 20 is connected to the first cable 60 and the second cable 70. If the first cable 60 and the second cable 70 are short-circuited at first time t3 in short-circuit step ST34, the short-circuit detection circuit 236 in the first indoor unit 20 detects short-circuit between the first cable 60 and the second cable 70 at second time t4 after the first time t3, and transmits a predetermined electric signal to the control circuit 237 (short-circuit detection step ST31).

When the control circuit 237 receives the predetermined electric signal, the control circuit 237 causes the operation unit 21 to execute protection behavior against abnormality (protection behavior step ST25).

Described next is behavior of the outdoor unit 40.

The outdoor unit 40 is connected to the first cable 60 and the second cable 70. If the first cable 60 and the second cable 70 are short-circuited at the first time 13 in short-circuit step ST34, the short-circuit detection circuit 436 in the outdoor unit 40 detects short-circuit between the first cable 60 and the second cable 70 at the second time t4 after the first time 13, and transmits a predetermined electric signal to the control circuit 437 (short-circuit detection step ST43).

When the control circuit 437 receives the predetermined electric signal, the control circuit 437 causes the operation unit 41 to execute protection behavior against abnormality (protection behavior step ST44.

As described above, even when the second indoor unit 30 has abnormality, the first indoor unit 20 and the outdoor unit 40 can be notified of abnormality more quickly by short-circuiting the first cable 60 and the second cable 70 serving as communication lines.

[Outdoor Unit According to Modification Example]

The protection board 43 in the outdoor unit 40 according to the above embodiment includes the second circuit 432 configured to cause the operation unit 41 to execute protection behavior upon detection of short-circuit. The protection board 43 may further include a third circuit 431 configured to short-circuit the first cable 60 and the second cable 70 upon detection of abnormality.

Figure 7:
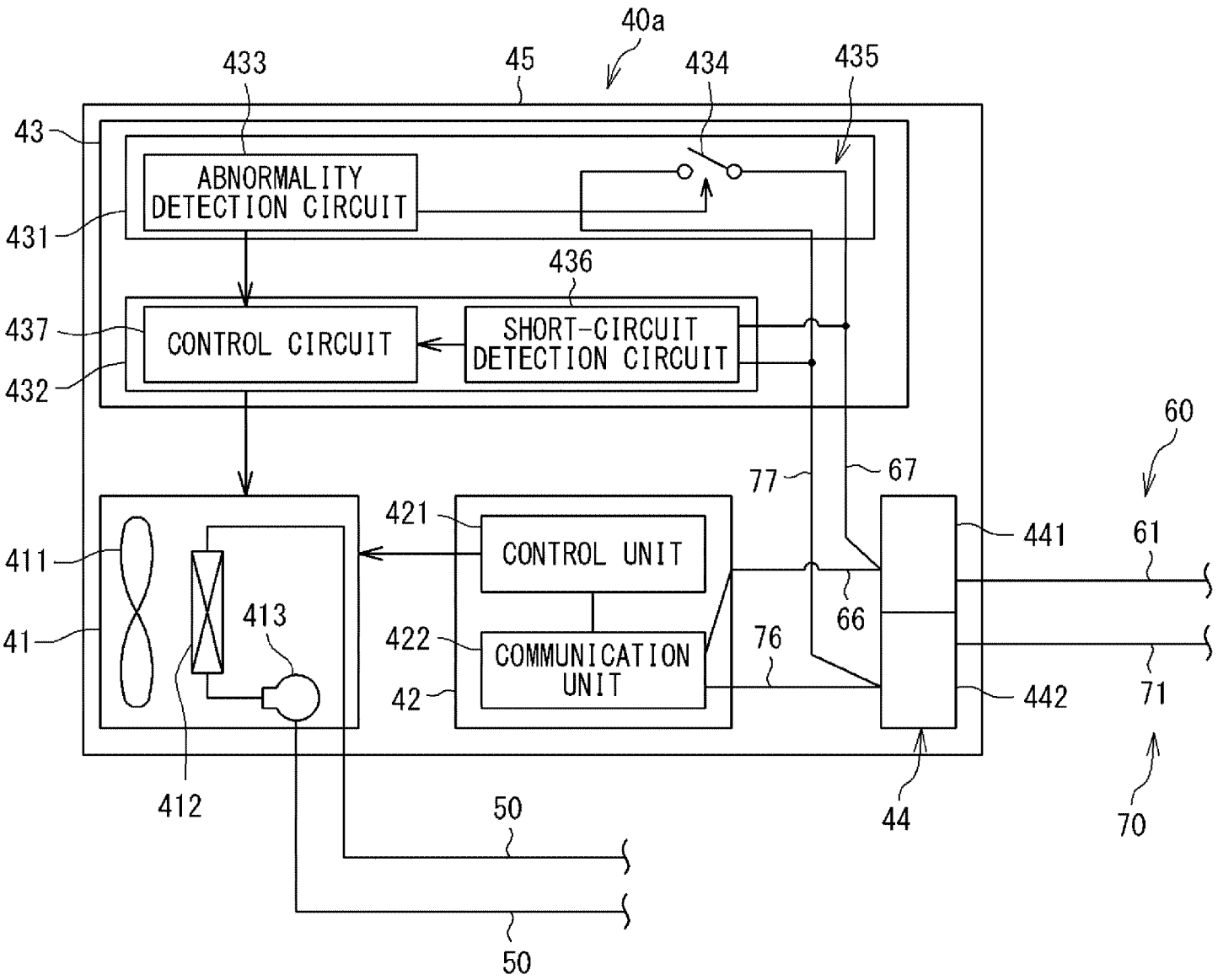
FIG. 7 is a diagram schematically depicting an outdoor unit according to a modification example.

FIG. 7 is a diagram schematically depicting an outdoor unit 40*a* according to a modification example. The outdoor unit 40*a* is different from the outdoor unit 40 according to the above embodiment in that the outdoor unit 40*a* includes the third circuit 431 and a sensor 47. The sensor 47 is configured similarly to the sensors 27 and 37, and is exemplarily configured to detect concentration of a refrigerant leaking in the outdoor unit 40*a*. The third circuit 431 includes an abnormality detection circuit 433, and a short circuit 435.

The abnormality detection circuit 433 is configured similarly to the abnormality detection circuits 233 and 333, and is electrically connected to the sensor 47. When the abnormality detection circuit 433 detects any abnormality of the outdoor unit 40*a* in accordance with a detection signal of the sensor 47, the abnormality detection circuit 433 transmits a predetermined electric signal to each of the short circuit 435 and control circuit 437.

The short circuit 435 is configured similarly to the short-circuits 235 and 335, and includes cables 67 and 77, and a switch 434. The cables 67 and 77 are connected to the first terminal 441 and the second terminal 442, respectively. The switch 434 is turned from the opened state into the connected state when the short circuit 435 receives the predetermined electric signal from the abnormality detection circuit 433. This leads to short-circuit of the first cable 60 and the second cable 70.

Such a configuration enables quicker notification of abnormality in the outdoor unit 40*a* to the first indoor unit 20 and the second indoor unit 30. In this case, the outdoor unit 40*a* may function as the "first device" according to the present disclosure.

[Refrigeration System According to Modification Example]

Figure 8:
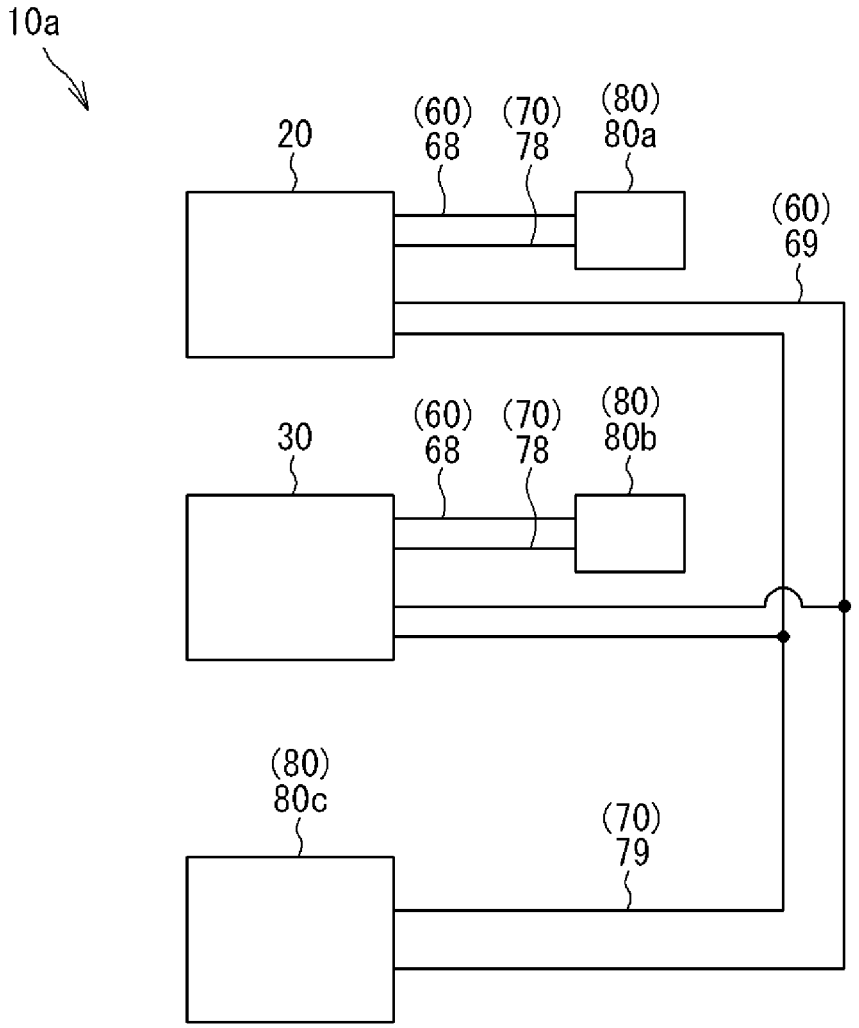
FIG. 8 is a diagram schematically depicting a configuration of a refrigeration system according to a modification example.

FIG. 8 is a diagram schematically depicting a configuration of a refrigeration system 10*a* according to a modification example. When the first indoor unit 20 comes into the abnormal state in the refrigeration system 10*a*, the first cable 60 and the second cable 70 used as communication lines are short-circuited to achieve quicker notification of the abnormal state to a different device (e.g. the remote controller 80) connected to the first cable 60 and the second cable 70.

The refrigeration system 10*a* includes the first indoor unit 20, the second indoor unit 30, the outdoor unit 40 (not depicted in FIG. 8), the refrigerant pipe 50 (not depicted in FIG. 8), the first cable 60, the second cable 70, and a plurality of remote controllers 80*a*, 80*b*, and 80*c*. Each of the remote controllers 80*a*, 80*b*, and 80*c* will be simply called the "remote controller 80" when the remote controllers 80*a*, 80*b*, and 80*c* are not particularly distinguished from one another. According to the present modification example, the first indoor unit 20 exemplifies the "first device", and the remote controller 80 exemplifies the "second device".

The remote controllers 80*a* and 80*b* are wiredly connected to the indoor units 20 and 30 one by one. Specifically, the remote controller 80*a* is communicably connected to the first indoor unit 20 via an outer region 68 of the first cable 60 and an outer region 78 of the second cable 70. The remote controller 80*b* is communicably connected to the second indoor unit 30 via the outer region 68 of the first cable 60 and the outer region 78 of the second cable 70. For example, the remote controller 80*a* is disposed in the indoor space S11 (FIG. 1), and the second remote controller 80*b* is disposed in the indoor space S21 (FIG. 1).

The single remote controller 80*c* is multiply and wiredly connected to the plurality of indoor units 20 and 30, and is also referred to as a centralized control device. Specifically, the remote controller 80*c* is communicably connected to the first indoor unit 20 and the second indoor unit 30 via an outer region 69 of the first cable 60 and an outer region 79 of the second cable 70. For example, the remote controller 80*c* is disposed in a space (e.g. a machine chamber) different from the indoor space S11 and the indoor space S21.

Figure 9:
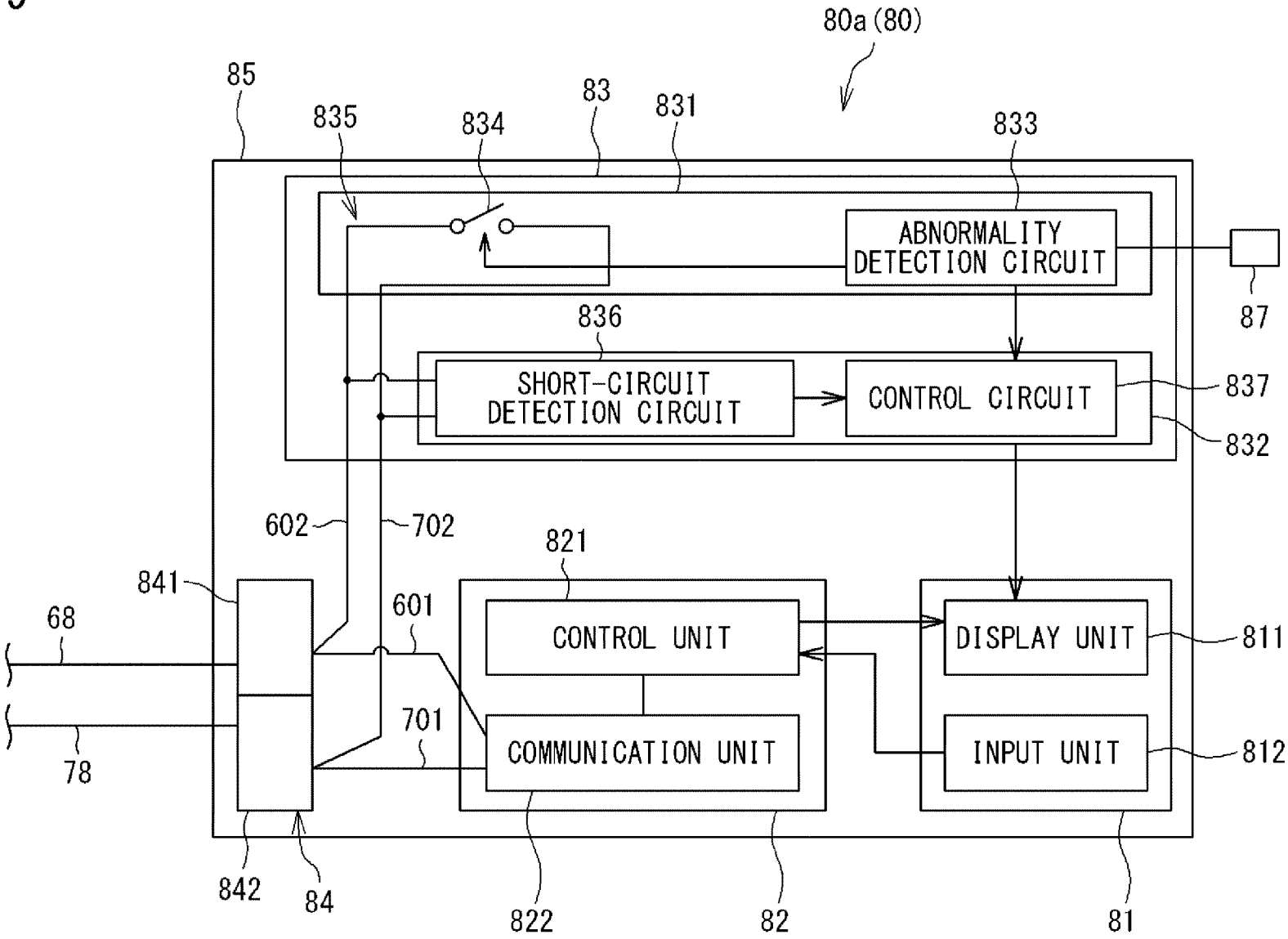
FIG. 9 is a diagram schematically depicting an internal configuration of a remote controller according to a modification example.

FIG. 9 is a diagram schematically depicting an internal configuration of the remote controller 80*a*. The remote controller 80*a* includes a control board 82, a protection board 83, a terminal block 84, a case 85, and a sensor 87. These components are configured similarly to the control board 22, the protection board 23, the terminal block 24, the case 25, and the sensor 27 in the first indoor unit 20. The remote controller 80*a* will not be described repeatedly where appropriate in terms of components configured similarly to the components of the first indoor unit 20.

The remote controller 80*a* further includes an operation unit 81. The operation unit 81 includes a display unit 811 configured to display various contents to a user, and an input unit 812 configured to receive input from a user. The display unit 811 includes a display and a speaker, and displays various contents in accordance with a command from a control unit 821 and a control circuit 837 to be described later. The input unit 812 receives input for control of the first indoor unit 20. For example, the input unit 812 includes a button operated by a user to set temperature, airflow volume, airflow direction, or the like. Upon receipt of input by a user, the input unit 812 transmits the input to the control unit 821 to be described later.

The control board 82 is configured to control normal behavior of the remote controller 80*a*, and includes the control unit 821 and a communication unit 822. These components are configured similarly to the control unit 221 and the communication unit 222. The control board 82 is connected with the first cable 60 and the second cable 70. Specifically, the first cable 60 (an inner region 601) is connected between a first terminal 841 and the control board 82, and the second cable 70 (an inner region 701) is connected between a second terminal 842 and the control board 82. The communication unit 822 communicates with a different device (e.g. the first indoor unit 20) included in the refrigeration system 10*a*.

The protection board 83 includes a third circuit 831 and a second circuit 832. Each of the third circuit 831 and the second circuit 832 is constituted only by hardware. The third circuit 831 is configured similarly to the first circuit 231, and the second circuit 832 is configured similarly to the fourth circuit 232.

The third circuit 831 includes an abnormality detection circuit 833, and a short circuit 835. The short circuit 835 includes a cable 602, a cable 702, and a switch 834. These components are configured similarly to the abnormality detection circuit 233, the short circuit 235, the cable 63, the cable 73, and the switch 234.

The second circuit 832 is configured to start protection behavior for the remote controller 80*a* when the first cable 60 and the second cable 70 are short-circuited. The second circuit 832 includes a short-circuit detection circuit 836, and the control circuit 837. These components are configured similarly to the short-circuit detection circuit 236 and the control circuit 237.

When the short-circuit detection circuit 836 detects short-circuit between the first cable 60 and the second cable 70 and the control circuit 837 receives the predetermined electric signal, the control circuit 837 controls the operation unit 81 to execute protection behavior against abnormality. The protection behavior to be executed by the operation unit 81 includes abnormality notifying behavior. The abnormality notifying behavior according to the present modification example includes display of refrigerant leakage on the display unit 811 by means of light or sound. Such behavior can achieve notification of refrigerant leakage to a user.

The terminal block 84 includes the first terminal 841 and the second terminal 842. These components are configured similarly to the first terminal 241 and the second terminal 242. The outer region 68 of the first cable 60 electrically connects the first terminal 841 and the first terminal 241 (FIG. 2), and the outer region 78 of the second cable 70 electrically connects the second terminal 842 and the second terminal 242 (FIG. 2).

The remote controller 80*b* is different from the remote controller 80*a* in that the remote controller 80*b* includes the input unit 812 for control of the second indoor unit 30. The remaining components are configured similarly to the components of the remote controller 80*a* and will thus not be described repeatedly.

The remote controller 80*c* includes the input unit 812 for control of the first indoor unit 20 and the second indoor unit 30. The remote controller 80*c* does not include the third circuit 831 or the sensor 87, and the short-circuit detection circuit 836 is electrically connected to the inner region 601 and the inner region 701. The remote controller 80*c* is different from the remote controller 80*a* in these points. The remaining components are configured similarly to the components of the remote controller 80*a* and will thus not be described repeatedly.

Description is made next to behavior of the refrigeration system 10*a*. When the abnormality detection circuit 233 detects any abnormality in accordance with a detection signal of the sensor 27 in the first indoor unit 20 (FIG. 2), the short circuit 235 short-circuits the first cable 60 and the second cable 70. This leads to short-circuit of the outer region 68 and the outer region 78. This also leads to short-circuit of the outer region 69 and the outer region 79. Accordingly, the short-circuit detection circuit 836 in the remote controller 80 detects short-circuit, and the control circuit 837 causes the operation unit 81 to execute protection behavior. For example, the display unit 811 generates buzzer sound in order to notify a user of abnormality relevant to refrigerant leakage.

As described above, when the first indoor unit 20 (exemplifying the first device) detects abnormality relevant to refrigerant leakage, the remote controller 80 (exemplifying the second device) detects the abnormality by detecting short-circuit of the first cable 60 and the second cable 70, for quicker protection behavior.

The remote controller 80 may alternatively detect abnormality relevant to refrigerant leakage in the present modification example. Specifically, when the abnormality detection circuit 833 detects abnormality in accordance with a detection signal of the sensor 87 in the remote controller 80*a*, the short circuit 835 short-circuits the first cable 60 and the second cable 70. Accordingly, the short-circuit detection circuit 236 in the first indoor unit 20 detects short-circuit, and the control circuit 237 causes the operation unit 81 to execute protection behavior.

In this case, the remote controller 80 functions as the "first device", the third circuit 831 functions as the "first circuit", and the second circuit 832 functions as the "fourth circuit" according to the present disclosure. The first indoor unit 20 functions as the "second device", and the first circuit 231 functions as the "third circuit" according to the present disclosure. In this manner, the remote controller 80 and the first indoor unit 20 have both the function as the "first device" and the function as the "second device" according to the present disclosure.

According to the above modification example, the remote controller 80*c* (centralized control device) is communicably connected to the first indoor unit 20 and the second indoor unit 30 via the first cable 60 and the second cable 70. However, the remote controller 80*c* should not be limited thereto in terms of its connection mode. For example, the remote controller 80*c* may alternatively be communicably connected to a plurality of outdoor units 40 (e.g. a first outdoor unit 401 and a second outdoor unit 402) via the first cable 60 and the second cable 70. In this case, if abnormality relevant to refrigerant leakage is detected in the first outdoor unit 401 and the first cable 60 and the second cable 70 are short-circuited, the remote controller 80*c* detects short-circuit of the first cable 60 and the second cable 70, and causes the operation unit 81 to execute protection behavior.

[Refrigerant Pipe According to Modification Example]

The refrigerant pipe 50 according to the above embodiment causes refrigerant circulation to both the first device (e.g. the first indoor unit 20) and the second device (e.g. the second indoor unit 30). However, the refrigerant pipe 50 does not necessarily need to cause refrigerant circulation to both the first device and the second device, and may alternatively cause refrigerant circulation only in the first device or the second device.

For example, in the refrigeration system 10*a* (FIG. 8) according to the modification example, the refrigerant pipe 50 is not connected with the remote controller 80. In an exemplary case where the remote controller 80 functions as the second device, the refrigerant pipe 50 accordingly needs to cause refrigerant circulation only in the first device (e.g. the first indoor unit 20), without need to cause refrigerant circulation to both the first device and the second device.

[First Cable and Second Cable According to Modification Example]

Figure 10:
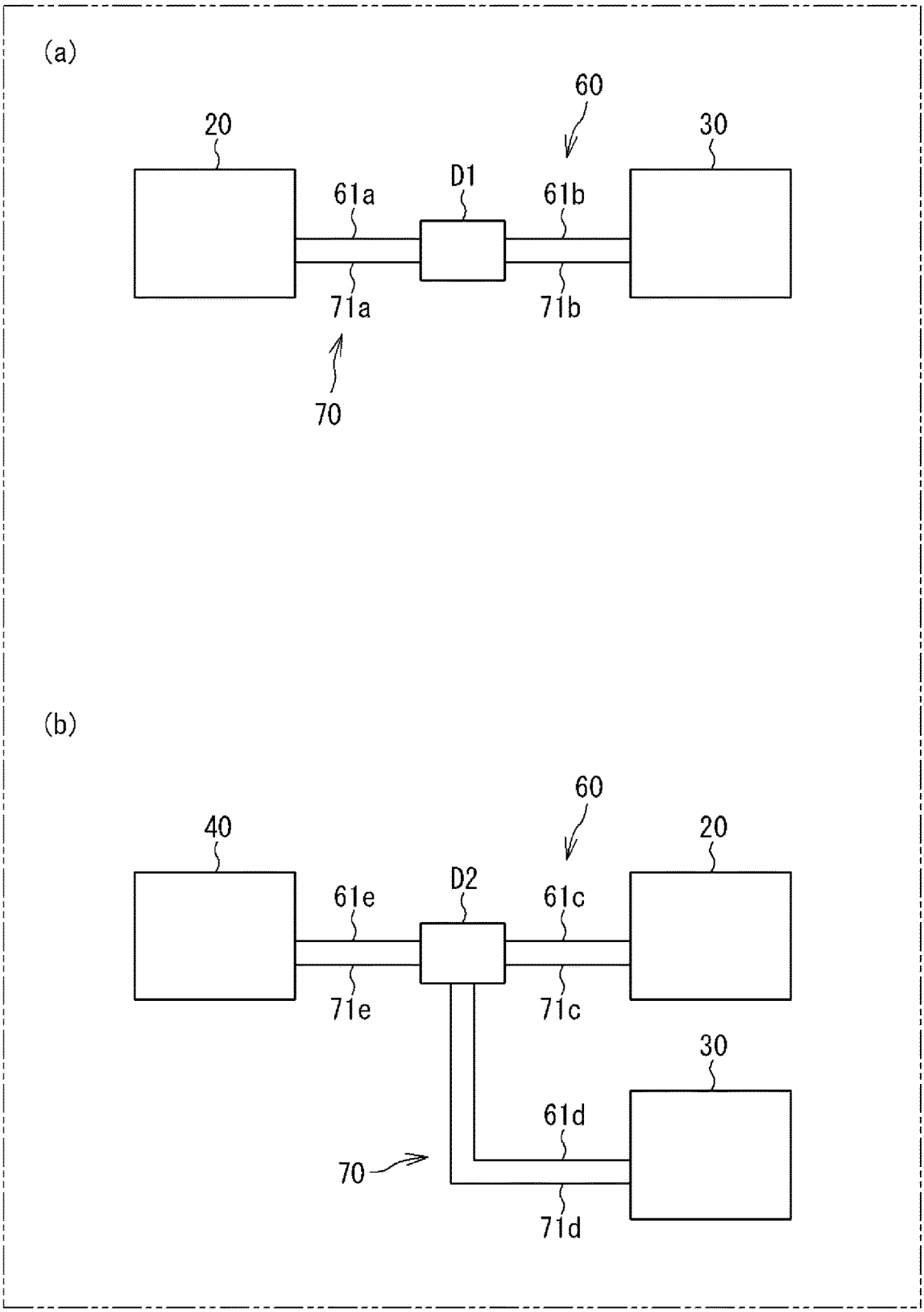
FIG. 10 is a diagram schematically depicting a first cable and a second cable according to a modification example.

FIG. 10 is a diagram schematically depicting the first cable 60 and the second cable 70 according to a modification example.

According to the above embodiment, the first indoor unit 20 (exemplifying the first device), the second indoor unit 30 (exemplifying the second device), and the outdoor unit 40 (exemplifying the second device) are directly connected via the first cable 60 and the second cable 70, without insertion of any other device. However, the first cable 60 and the second cable 70 have only to electrically connect the first indoor unit 20, the second indoor unit 30, and the outdoor unit 40, without need to directly connect the first indoor unit 20, the second indoor unit 30, and the outdoor unit 40.

For example, the first indoor unit 20 and the second indoor unit 30 may interpose a device D1 (e.g. an amplifier circuit) as depicted in FIG. 10(*a*), to divide the first cable 60 into two cables in a first region 61*a* and a second region 61*b*, and divide the second cable 70 to two cables in a first region 71*a* and a second region 71*b*.

The first indoor unit 20, the second indoor unit 30, and the outdoor unit 40 may interpose a device D2 (e.g. a branching circuit) therebetween as depicted in FIG. 10(*b*), to branch the first cable 60 and the second cable 70. In this case, the first cable 60 may be divided into three cables in a first region 61*c* connecting from the device D1 to the first indoor unit 20, a second region 61*d* connecting from the device D2 to the second indoor unit 30, and a third region 61*e* connecting from the device D2 to the outdoor unit 40. The second cable 70 may be divided into three cables in a first region 71*c* connecting from the device D2 to the first indoor unit 20, a second region 71*d* connecting from the device D2 to the second indoor unit 30, and a third region 71*e* connecting from the device D2 to the outdoor unit 40.

Furthermore, the first cable 60 and the second cable 70 have only to have two poles, without need to be physically divided into two cables. For example, the first cable 60 and the second cable 70 may be collectively provided as a single cable.

[Protection Board According to Modification Example]

The protection board 23 according to the above embodiment includes the first circuit 231 and the fourth circuit 232. Alternatively, the protection board 23 may not include the fourth circuit 232. In this case, the abnormality detection circuit 233 in the first circuit 231 may be electrically connected to the control unit 221, so as to transmit a predetermined electric signal to the control unit 221 upon abnormality detection.

[Protection Board Installation Site According to Modification Example]

The protection board 23 according to the above embodiment is accommodated in the case 25. The protection board 23 may alternatively be disposed outside the case 25. In this case, the protection board 23 may be accommodated in a second case (not denoted) provided separately from the case 25 and disposed in the ceiling space S12. The second case may accommodate, in addition to the protection board 23, the sensor 27 or the like. Similarly, the protection boards 33 and 43 may alternatively be disposed outside the cases 35 and 45, respectively.

[Protection Behavior According to Modification Example]

The control circuit 237 may alternatively determine contents of protection behavior in accordance with whether or not the control circuit 237 receives a predetermined electric signal from the abnormality detection circuit 233. For example, when the control circuit 237 receives the predetermined electric signal from each of the short-circuit detection circuit 236 and the abnormality detection circuit 233, the first indoor unit 20 itself has abnormality. Accordingly, the control circuit 237 executes protection behavior including both abnormality inhibiting behavior (e.g. rotating the fan 211 to have the maximum number of revolutions), and abnormality notifying behavior (e.g. flickering the LED on the display unit 213).

In a different exemplary case where the control circuit 237 receives a predetermined electric signal from the short-circuit detection circuit 236 but does not receive any predetermined electric signal from the abnormality detection circuit 233, the second indoor unit 30 has abnormality whereas the first indoor unit 20 itself has no abnormality. When the first indoor unit 20 and the second indoor unit 30 are disposed in different chambers as in the above embodiment, abnormality inhibiting behavior is not highly necessary in the first indoor unit 20 even if the second indoor unit 30 has refrigerant leakage. Furthermore, a user may feel uncomfortable with abnormality inhibiting behavior of rotating the fan 211 to have the maximum number of revolutions in the first indoor unit 20 or the like.

If the control circuit 237 receives the predetermined electric signal from the short-circuit detection circuit 236 but does not receive any predetermined electric signal from the abnormality detection circuit 233, the control circuit 237 may thus cause the operation unit 21 to execute only abnormality notifying behavior without executing abnormality inhibiting behavior.

In the refrigeration system 10 thus configured, protection behavior including both abnormality inhibiting behavior and abnormality notifying behavior can be executed in a device having abnormality (e.g. the second indoor unit 30), whereas protection behavior including only abnormality notifying behavior can be executed in a device having no abnormality (e.g. the first indoor unit 20). This can inhibit a user of the first indoor unit 20 from feeling uncomfortable as well as can more quickly notify the user of abnormality of the refrigeration system 10. The outdoor unit 40 may execute abnormality inhibiting behavior even if the outdoor unit 40 itself does not have any abnormality.

Other Modification Examples

The refrigerant pipe 50 according to the above embodiment directly connects the first indoor unit 20 and the second indoor unit 30. However, the refrigerant pipe 50 has only to function to cause refrigerant circulation to the first indoor unit 20 and the second indoor unit 30, and the refrigerant pipe 50 may not directly connect the first indoor unit 20 and the second indoor unit 30. For example, the first indoor unit 20 and the second indoor unit 30 may interpose different indoor unit (or outdoor unit) or a branching unit configured to branch the refrigerant pipe 50, so that the refrigerant pipe 50 is connected to the first indoor unit 20 and the second indoor unit 30 via the different indoor unit or the like. In this case, the refrigerant pipe 50 is not provided between the first indoor unit 20 and the second indoor unit 30. However, the refrigerant pipe 50 can cause refrigerant circulation to the first indoor unit 20 and the second indoor unit 30 via the different indoor unit. Similarly, the refrigerant pipe 50 has only to function to cause refrigerant circulation to the first indoor unit 20 and the outdoor unit 40, and the refrigerant pipe 50 may not directly connect the first indoor unit 20 and the outdoor unit 40.

At least parts of the embodiments described above may be appropriately combined with each other.

Functional Effects of Embodiments

Technical Problem

Conventionally, an indoor control device configured to control an indoor unit and an outdoor control device configured to control an outdoor unit are connected by a transmission line (communication line), to enable transmission and reception of information. The outdoor control device has been conventionally notified of any abnormality of the indoor unit via the transmission line to stop a compressor or the like mounted to the outdoor unit. In order to enhance safety of a refrigeration system including a plurality of devices (e.g. an indoor unit and an outdoor unit), after abnormality is detected in a first device (e.g. the indoor unit), it is necessary to more quickly notify, of the abnormality, a second device (e.g. the outdoor unit) different from the first device. It is an object of the present disclosure to provide a refrigeration system configured to notify abnormality more quickly.

(Action and Effects)

(1) The refrigeration system 10, 10*a* according to the above embodiment or modification example includes the first device 20, 80, the second device 20, 30, 40, 80 communicably connected to the first device 20, 80 via the first cable 60 and the second cable 70, and the refrigerant pipe 50 configured to cause refrigerant circulation to the first device 20, 80 or the second device 20, 30, 40, 80, in which the first device 20, 80 includes the first circuit 231, 831 configured to short-circuit the first cable 60 and the second cable 70 upon detection of abnormality relevant to refrigerant leakage, and the second device 20, 30, 40, 80 includes the second circuit 232, 332, 432, 832 configured to start protection behavior against abnormality when the first cable 60 and the second cable 70 are short-circuited.

In the refrigeration system 10, 10*a*, the second device 20, 30, 40, 80 can be notified more quickly of the abnormality detected by the first device 20, 80 by short-circuiting the first cable 60 and the second cable 70 used for communication between the first device 20, 80 and the second device 20, 30, 40, 80. This enables an earlier start of protection behavior against to abnormality.

(2) In the refrigeration system 10, 10*a* according to the above embodiment or modification example, the first circuit 231, 831 includes the abnormality detection circuit 233, 833 configured to detect abnormality relevant to refrigerant leakage, and the short circuit 235, 835 including the switch 234, 834 connected parallelly to the first cable 60 and the second cable 70, the short-circuit configured to turn the switch 234, 834 from an opened state into a connected state when the abnormality detection circuit 233, 833 detects abnormality relevant to refrigerant leakage.

(3) In the refrigeration system 10, 10*a* according to the above embodiment or modification example, the abnormality detection circuit 233,833 detects abnormality in accordance with a detection signal of the sensor 27, 87 configured to detect refrigerant leakage.

(4) In the refrigeration system 10, 10*a* according to the above embodiment or modification example, the second circuit 232, 332, 432, 832 includes the short-circuit detection circuit 236, 336, 436, 836 configured to detect short-circuit between the first cable 60 and the second cable 70, and the control circuit 237, 337, 437, 837 electrically connected to the operation unit 21, 31, 41, 81 configured to execute protection behavior against abnormality, the control circuit configured to control the operation unit 21, 31, 41, 81 when the short-circuit detection circuit 236, 336, 436, 836 detects short-circuit between the first cable 60 and the second cable 70, and the second circuit 232, 332, 432, 832 is constituted only by hardware.

In the refrigeration system 10, 10*a*, the second circuit 232, 332, 432, 832 configured to start protection behavior for the second device 20, 30, 40, 80 is constituted only by hardware, to avoid any error caused by software or the like. This enables a more reliable start of protection behavior.

(5) In the refrigeration system 10 according to the above embodiment, the first device 20 is the first indoor unit 20, and the second device 30, 40 is the second indoor unit 30 or the outdoor unit 40.

(6) In the refrigeration system 10*a* according to the above modification example, the first device 20, 80 is one of the first indoor unit 20 and the remote controller 80 including the input unit 812 for control of the first indoor unit 20, and the second device 20, 80 is another one of the first indoor unit 20 and the remote controller 80.

(7) In the refrigeration system 10, 10*a* according to the above embodiment or modification example, the second device 20, 30, 40, 80 further includes the third circuit 231, 331, 431, 831 configured to short-circuit the first cable 60 and the second cable 70 upon detection of abnormality relevant to refrigerant leakage, and the first device 20, 80 further includes the fourth circuit 232, 832 configured to start protection behavior for the first device 20, 80 when the first cable 60 and the second cable 70 are short-circuited.

The first device 20, 80 can be notified more quickly of the abnormality of the second device 20, 30, 40, 80 by short-circuiting the first cable 60 and the second cable 70 used for communication between the first device 20, 80 and the second device 20, 30, 40, 80. This enables an earlier start of protection behavior for each of the first devices 20 and 80.

(8) In the refrigeration system 10, 10*a* according to the above embodiment or modification example, the first device 20, 80 includes the protection board 23, 83 including the first circuit 231, 831 and the fourth circuit 232, 832, and the control board 22, 82 provided separately from the protection board 23, 83 and configured to control behavior of the first device 20, 80.

When the protection board 23, 83 is provided separately from the control board 22, 82, protection behavior can be executed more reliably even when the control board 22, 82 has any abnormality.

(9) In the refrigeration system 10, 10*a* according to the above embodiment or modification example, the first device 20, 80 includes the protection board 23, 83 including the first circuit 231, 831, and the control board 22, 82 provided separately from the protection board 23, 83 and configured to control behavior of the first device 20, 80.

When the protection board 23, 83 is provided separately from the control board 22, 82, protection behavior can be executed more reliably even when the control board 22, 82 has any abnormality.

The embodiments have been described above. Various modifications to modes and details should be available without departing from the object and the scope of the claims.

REFERENCE SIGNS LIST

10 refrigeration system
10*a* refrigeration system
20 first indoor unit (exemplifying first device or second device)
21 operation unit
211 fan
212 heat exchanger
213 display unit
22 control board
221 control unit
222 communication unit
23 protection board
231 first circuit
232 fourth circuit

233 abnormality detection circuit
234 switch
235 short circuit
236 short-circuit detection circuit
237 control circuit
24 terminal block
241 first terminal
242 second terminal
25 case
26 remote controller
261 display unit
262 input unit
27 sensor
30 second indoor unit (exemplifying second device)
31 operation unit
311 fan
312 heat exchanger
313 display unit
32 control board
321 control unit
322 communication unit
33 protection board
331 third circuit
332 second circuit
333 abnormality detection circuit
334 switch
335 short circuit
336 short-circuit detection circuit
337 control circuit
34 terminal block
341 first terminal
342 second terminal
35 case
36 remote controller
361 display unit
362 input unit
37 sensor
40 outdoor unit (exemplifying second device)
40*a* outdoor unit (exemplifying first device or second device)
41 operation unit
411 fan
412 heat exchanger
413 compressor
42 control board
421 control unit
422 communication unit
43 protection board
431 third circuit
432 second circuit
433 abnormality detection circuit
434 switch
435 short circuit
436 short-circuit detection circuit
437 control circuit
44 terminal block
441 first terminal
442 second terminal
45 case
47 sensor
50 refrigerant pipe
60 first cable
61*a* first region
61*b* second region
61*c* first region
61*d* second region
61*e* third region
61 outer region
62, 64, 66 inner region
63 cable
65 cable
67 cable
68 outer region
69 outer region
601 inner region
602 cable
70 second cable
71*a* first region
71*b* second region
71*c* first region
71*d* second region
71*e* third region
71 outer region
72, 74, 76 inner region
73 cable
75 cable
77 cable
78 outer region
79 outer region
701 inner region
702 cable
80*a*, 80*b*, 80*c* remote controller
80 remote controller
81 operation unit
811 display unit
812 input unit
82 control board
821 control unit
822 communication unit
83 protection board
831 third circuit
832 second circuit
833 abnormality detection circuit
834 switch
835 short circuit
836 short-circuit detection circuit
837 control circuit
84 terminal block
841 first terminal
842 second terminal
85 case
87 sensor
S11 indoor space
S12 ceiling space
S21 indoor space
S22 ceiling space
S31 outdoor space
t1 first time
t2 second time
t3 first time
t4 second time
D1 device
D2 device

What is claimed is:

1. A refrigeration system comprising:

a first device;

a second device communicably connected to the first device via a first cable and a second cable; and a refrigerant pipe configured to cause refrigerant circulation to the first device or the second device, wherein the first device includes a first circuit configured to short-circuit the first cable and the second cable upon detection of abnormality relevant to refrigerant leakage, and the second device includes a second circuit configured to start protection behavior against abnormality in response to the first cable and the second cable being short-circuited.

2. The refrigeration system according to claim 1, wherein the first circuit includes an abnormality detection circuit configured to detect abnormality relevant to refrigerant leakage, and a short circuit including a switch connected parallelly to the first cable and the second cable, the short circuit configured to turn the switch from an opened state into a connected state in response to the abnormality detection circuit detecting abnormality relevant to refrigerant leakage.

3. The refrigeration system according to claim 2, wherein the abnormality detection circuit detects abnormality relevant to refrigerant leakage in accordance with a detection signal of a sensor configured to detect refrigerant leakage.

4. A refrigeration system comprising:

a first device;

a second device communicably connected to the first device via a first cable and a second cable; and a refrigerant pipe configured to cause refrigerant circulation to the first device or the second device, wherein the first device includes a first circuit configured to short-circuit the first cable and the second cable upon detection of abnormality relevant to refrigerant leakage, and the second device includes a second circuit configured to start protection behavior against abnormality in response to the first cable and the second cable being short-circuited, wherein the second circuit includes a short-circuit detection circuit configured to detect short-circuit between the first cable and the second cable, and a control circuit electrically connected to an operation unit configured to execute protection behavior against abnormality, the control circuit configured to control the operation unit in response to the short-circuit detection circuit detectings short-circuit between the first cable and the second cable, and the second circuit is constituted only by hardware.

5. The refrigeration system according to claims 1, wherein the first device is a first indoor unit, and the second device is a second indoor unit or an outdoor unit.

6. The refrigeration system according to claims 1, wherein the first device is one of a first indoor unit and a remote controller including an input unit for control of the first indoor unit, and the second device is another one of the first indoor unit and the remote controller.

7. The refrigeration system according to claim 1, wherein the first device includes a protection board including the first circuit, and a control board provided separately from the protection board and configured to control behavior of the first device.

8. The refrigeration system according to claim 1, further comprising a short-circuit detection circuit configured to detect a short circuit between the first cable and the second cable.

9. A refrigeration system comprising:

a first device;

a second device communicably connected to the first device via a first cable and a second cable; and a refrigerant pipe configured to cause refrigerant circulation to the first device or the second device, wherein the first device includes a first circuit configured to short-circuit the first cable and the second cable upon detection of abnormality relevant to refrigerant leakage, and the second device includes a second circuit configured to start protection behavior against abnormality in response to the first cable and the second cable being short-circuited, wherein the second device further includes a third circuit configured to short-circuit the first cable and the second cable upon detection of abnormality relevant to refrigerant leakage, and the first device further includes a fourth circuit configured to start protection behavior for the first device in response to the first cable and the second cable are being short-circuited.

10. The refrigeration system according to claim 9, wherein the first device includes a protection board including the first circuit and the fourth circuit, and a control board provided separately from the protection board and configured to control behavior of the first device.

* * * * *